US011276539B2

(12) United States Patent
Sakai et al.

(10) Patent No.: US 11,276,539 B2
(45) **Date of Patent: *Mar. 15, 2022**

(54) ELECTROMAGNETIC DEVICE AND ELECTROMAGNETIC RELAY EQUIPPED WITH ELECTROMAGNETIC DEVICE

(71) Applicant: PANASONIC INTELLECTUAL PROPERTY MANAGEMENT CO., LTD., Osaka (JP)

(72) Inventors: Satoshi Sakai, Mie (JP); Katsuya Uruma, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 209 days.

This patent is subject to a terminal disclaimer.

(21) Appl. No.: 16/570,378

(22) Filed: Sep. 13, 2019

(65) Prior Publication Data

US 2020/0006026 A1 Jan. 2, 2020

Related U.S. Application Data

(63) Continuation of application No. 15/619,885, filed on Jun. 12, 2017, now Pat. No. 10,446,350.

(30) Foreign Application Priority Data

Jun. 17, 2016 (JP) ..... JP2016-120688
Dec. 27, 2016 (JP) ..... JP2016-254026

(51) Int. Cl.
*H01H 9/00* (2006.01)
*H01H 50/20* (2006.01)
(Continued)

(52) U.S. Cl.
CPC ..... *H01H 50/20* (2013.01); *H01H 50/163* (2013.01); *H01H 50/36* (2013.01);
(Continued)

(58) Field of Classification Search
CPC ..... H01H 50/06; H01H 50/08; H01H 50/54; H01H 50/18; H01H 50/20; H01H 50/163;
(Continued)

(56) References Cited

U.S. PATENT DOCUMENTS 4,618,951 A * 10/1986 Okita ..... G11B 17/0284 720/707
4,719,692 A * 1/1988 Sakai ..... G11B 5/4826 29/603.06
(Continued)

FOREIGN PATENT DOCUMENTS

CN 203746760 U 7/2014
JP 50-138548 U 11/1975
(Continued)

*Primary Examiner* — Shawki S Ismail
*Assistant Examiner* — Lisa N Homza
(74) *Attorney, Agent, or Firm* — Greenblum & Bernstein, P.L.C.

(57) ABSTRACT

An electromagnetic device includes a fixed iron core through which a first magnetic flux flows, a movable iron core that reciprocates to separate from the fixed iron core by a predetermined gap when a current applied to a coil, which generates the first magnetic flux, is stopped and move to the fixed iron core by an attractive force when the current is applied to the coil. The electromagnetic device also includes a permanent magnet that generates a second magnetic flux. The opposed surface of the fixed iron core and the opposed surface of the movable iron core may be opposed in a reciprocating direction of the movable iron core. The permanent magnet may be attached to the fixed iron core such that a magnetized surface of the permanent magnet is opposed and exposed to the opposed surface of the movable iron core.

6 Claims, 17 Drawing Sheets

(51) Int. Cl.
*H01H 50/16* (2006.01)
*H01H 50/36* (2006.01)
*H01H 50/44* (2006.01)
*H01H 51/22* (2006.01)
*H01H 51/27* (2006.01)

(52) U.S. Cl.
CPC ..... *H01H 50/44* (2013.01); *H01H 51/2209* (2013.01); *H01H 51/27* (2013.01)

(58) Field of Classification Search
CPC ..... H01H 50/36; H01H 50/42; H01H 50/44; H01H 51/22; H01H 51/2209; H01H 51/27; H01H 51/065
USPC ..... 335/179
See application file for complete search history.

(56) References Cited

U.S. PATENT DOCUMENTS

2007/0241847 A1* 10/2007 Yamamoto ..... H01H 50/546 335/196
2008/0073620 A1* 3/2008 Taniguchi ..... C08L 2666/06 252/511
2009/0243771 A1* 10/2009 Uruma ..... H01H 50/04 335/193
2009/0322453 A1* 12/2009 Kawaguchi ..... H01F 7/1615 335/81
2011/0120846 A1* 5/2011 Ito ..... H01H 1/66 200/331
2013/0112669 A1* 5/2013 Uemura ..... H01J 37/32082 219/121.36
2013/0112670 A1* 5/2013 Yokogawa ..... H01J 37/32522 219/121.36
2015/0194284 A1* 7/2015 Uruma ..... H01H 9/443 335/179
2016/0300676 A1* 10/2016 Sakai ..... H01H 50/546
2016/0300680 A1* 10/2016 Yokoyama ..... H01H 1/22
2017/0365431 A1* 12/2017 Sakai ..... H01H 50/44
2017/0365432 A1* 12/2017 Sakai ..... H01H 50/44
2018/0061599 A1* 3/2018 Enomoto ..... H01H 1/0015

FOREIGN PATENT DOCUMENTS

JP 2003-151826 A 5/2003
JP 2010-10058 1/2010
JP 2010-118206 A 5/2010

* cited by examiner

ELECTROMAGNETIC DEVICE AND ELECTROMAGNETIC RELAY EQUIPPED WITH ELECTROMAGNETIC DEVICE

CROSS REFERENCE TO RELATED APPLICATIONS

This is a Continuation Application of U.S. patent application Ser. No. 15/619,885, filed Jun. 12, 2017 which claims priority to Japanese Patent Application No. 2016-254026 filed on Dec. 27, 2016 and Japanese Patent Application No. 2016-120688 filed on Jun. 17, 2016. The disclosures of the above-mentioned documents are incorporated by reference herein in their entireties.

BACKGROUND OF THE INVENTION

The present invention relates to an electromagnetic device and an electromagnetic relay equipped with the electromagnetic device.

JP 2010-010058 (hereinafter, referred to as Patent Literature 1) discloses an electromagnetic device including a coil which generates a magnetic flux when a current is applied, a fixed member through which the generated magnetic flux flows, and a movable member which reciprocates to separate from the fixed member by a predetermined gap when the current applied to the coil is stopped and move to the fixed member by an attractive force when the current is applied to the coil.

The movable member in Patent Literature 1 can be driven with smaller power consumption by use of a magnetic force of a permanent magnet provided in the movable member.

In the electromagnetic device disclosed in Patent Literature 1, the amount of the magnetic flux generated by the permanent magnet and flowing through the opposed surface (the magnetic pole face) of the movable member opposed to the fixed member tends to decrease, since the permanent magnet is located in the middle of the movable member in the reciprocation direction. Namely, the magnetic flux generated by the permanent magnet contributing to improving the attractive force acting on the movable member for moving toward the fixed member is reduced.

Since the conventional technology cannot allow the magnetic flux generated by the permanent magnet to efficiently flow through the magnetic pole face, there remains a need for improvement in the attractive force acting on the movable member for moving toward the fixed member.

SUMMARY OF THE INVENTION

An object of the present invention is to provide an electromagnetic device with improved attractive force acting on a movable member for moving toward a fixed member, and an electromagnetic relay equipped with the electromagnetic device.

An electromagnetic device according to the present invention includes: a coil configured to generate a first magnetic flux when a current is applied thereto; a fixed member through which the first magnetic flux flows; a movable member configured to reciprocate to separate from the fixed member by a predetermined gap when the current applied to the coil is stopped and move to the fixed member by an attractive force when the current is applied to the coil; and a permanent magnet configured to generate a second magnetic flux between opposed surfaces of the fixed member and the movable member in a direction conforming to the first magnetic flux.

The permanent magnet is attached to at least one of the fixed member and the movable member such that a magnetized surface of the permanent magnet is opposed and exposed to the opposed surface of the other one of the fixed member and the movable member.

An electromagnetic relay according to the present invention is equipped with the electromagnetic device.

DESCRIPTION OF THE EMBODIMENTS

Figure 1:
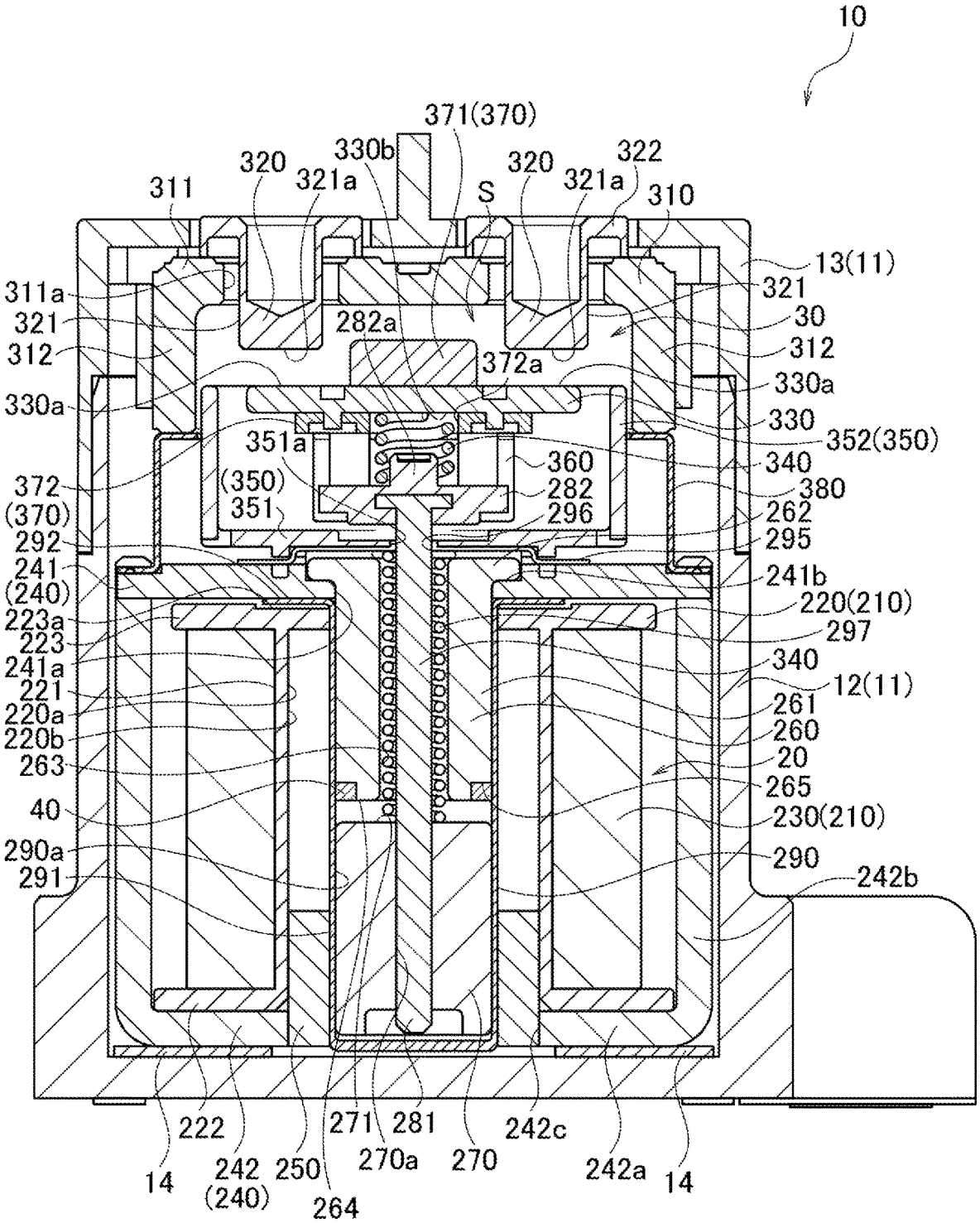
FIG. 1 is a cross-sectional view of an electromagnetic relay according to a first embodiment of the present invention.

Hereinafter, embodiments of the present invention will be described with reference to the drawings. As used herein, the definitions of the top, bottom, right, and left applied to FIG. 1 are used for the explanations of the drawings throughout the Specification. The direction perpendicular to the paper of FIG. 1 is referred to as a front-rear direction.

The following embodiments include the similar elements. The similar elements are designated by the common reference numerals, and overlapping explanations thereof are not repeated below.

First Embodiment

An electromagnetic relay 10 according to the present embodiment is of a normally open type in which contact points are OFF in an initial state. As shown in FIG. 1, the electromagnetic relay 10 includes an electromagnetic device 20 located on the lower side and a contact device 30 located on the upper side. The electromagnetic device 20 and the contact device 30 are housed in a case 11 formed into a hollow box shape and made of a polymer material. An electromagnetic relay of a normally closed type in which contact points are ON in the initial state may be used instead.

The case 11 includes a substantially box-shaped case body 12 open on the upper side, and a case cover 13 covering the opening of the case body 12. The electromagnetic device 20 and the contact device 30 are housed in the inside space of the case 11 with the case body 12 covered with the case cover 13. In the present embodiment, a damper rubber 14 made of an elastic rubber material is placed on the bottom of the case body 12. The electromagnetic device 20 is installed on the bottom of the case body 12 with the damper rubber 14 interposed therebetween.

Figure 2:
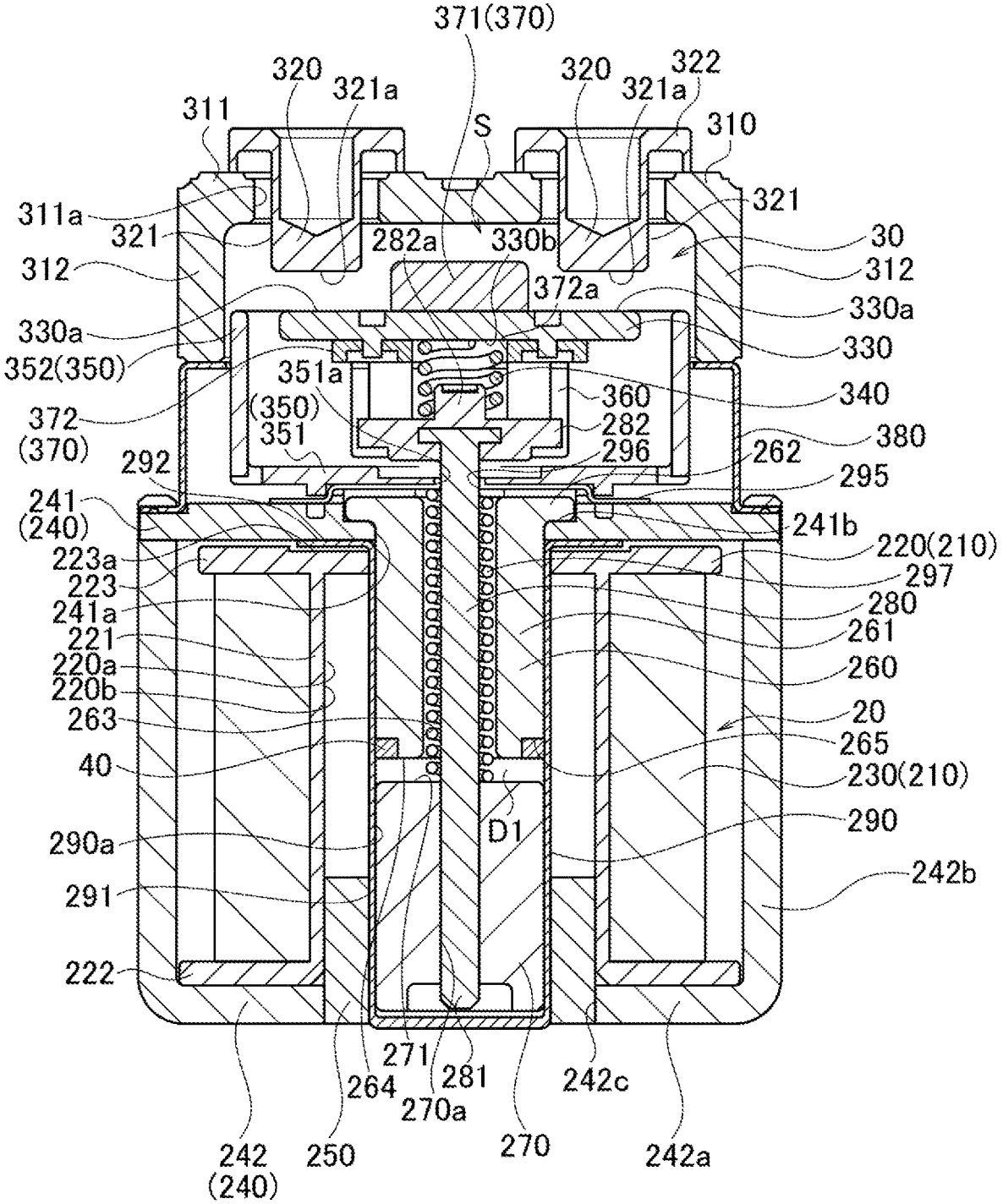
FIG. 2 is a cross-sectional view of a contact device and an electromagnetic device according to the first embodiment of the present invention.
Figure 4:
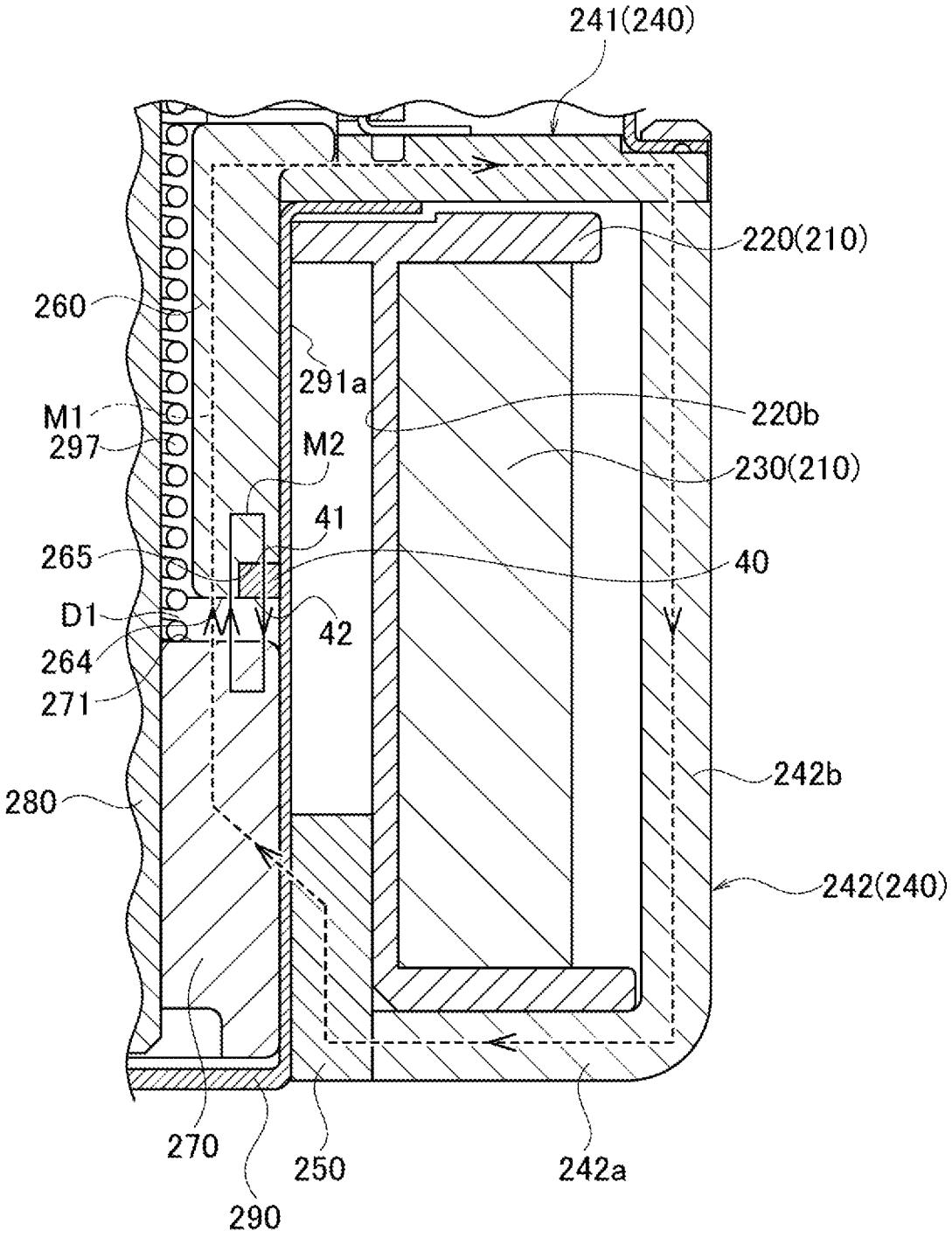
FIG. 4 is a view for schematically illustrating a flow of a magnetic flux generated in the electromagnetic relay according to the first embodiment of the present invention.

The electromagnetic device 20 includes a coil unit 210. The coil unit 210 includes a coil 230 which generates first magnetic flux M1 when a current is applied thereto, and a cylindrical hollow coil bobbin 220 on which the coil 230 is wound, as shown in FIG. 2 and FIG. 4.

Although not illustrated in the drawings, a pair of coil terminals is fixed to the coil bobbin 220 and connected with both ends of the coil 230. The electromagnetic device 20 is driven when the current is applied to the coil 230 through the pair of coil terminals. The driven electromagnetic device 20 operates to open and close fixed contact points 321*a* and movable contact points 330*a* of the contact device 30, as described below, so as to switch the electrical connection between a pair of fixed terminals 320.

The coil bobbin 220 is made of an insulating resin material and provided with an insertion hole 220*a* penetrating the middle of the coil bobbin 220 in the vertical direction. The coil bobbin 220 includes a wound body 221 having a substantially cylindrical shape on which the coil 230 is wound around the outer surface, a lower flange 222 having a substantially circular shape continuously formed on the bottom of the wound body 221 and extending outward in the radial direction of the wound body 221, and an upper flange 223 having a substantially circular shape continuously formed on the top of the wound body 221 and extending outward in the radial direction of the wound body 221. In the present embodiment, the upper flange 223 also protrudes inward in the radial direction of the wound body 221. The diameter of the opening of the insertion hole 220*a* is smaller on the upper side than on the lower side.

The electromagnetic device 20 further includes a yoke 240 placed around the coil 230. The yoke 240 is made of a magnetic material and surrounds the coil bobbin 220. In the present embodiment, the yoke 240 includes a rectangular yoke upper plate 241 located on the upper surface of the coil bobbin 220, and a rectangular yoke 242 located on the lower surface and the side surface of the coil bobbin 220.

The yoke 242 is located between the coil 230 and the case 11. The yoke 242 includes a bottom wall 242*a* and a pair of side walls 242*h* extending upward from the right and left edges (circumferential edges) of the bottom wall 242*a*, and is open in the front-rear direction. The bottom wall 242*a* and the pair of the side walls 242*b* may be integrated and formed such that a single plate is bent. The bottom wall 242*a* of the yoke 242 is provided with a circular insertion hole 242*c* into which a bushing 250 made of a magnetic material is inserted.

The yoke upper plate 241 is placed on the end side (on the upper side) of the pair of the side walls 242*b* of the yoke 242 to cover the upper surface of the coil bobbin 220 and the coil 230 wound on the coil bobbin 220.

The electromagnetic device 20 includes a fixed iron core (a fixed member) 260 which is placed in the cylindrical inner portion (in the insertion hole 220*a*) of the coil bobbin 220 and magnetized by the coil 230 applied with the current (allows the first magnetic flux M1 to flow therethrough), and a movable iron core (a movable member) 270 which is opposed to the fixed iron core 260 in the vertical direction (in the shaft direction) and placed in the cylindrical inner portion (in the insertion hole 220*a*) of the coil bobbin 220.

The fixed iron core 260 includes a cylinder portion 261 inserted into the cylindrical inner portion (in the insertion hole 220*a*) of the coil bobbin 220, and a flange 262 extending outward in the radial direction from the upper end of the cylinder portion 261. The fixed iron core 260 is provided with an insertion hole 263 into which a shaft (a drive shaft) 280 and a return spring 297 are inserted. The movable iron core 270 is provided with an insertion hole 270*a* into which the shaft (the drive shaft) 280 is inserted and fixed.

The shaft 280 is made of a nonmagnetic material, and includes a shaft body 281 having a round rod shape elongated in the moving direction of the movable iron core 270 (in the vertical direction: the drive-shaft direction) and a flange 282 having a substantially circular shape and extending outward in the radial direction from the upper end of the shaft body 281.

The bottom end of the shaft body 281 is inserted from the top of the insertion hole 270*a* of the movable iron core 270 so that the shaft 280 is connected to the movable iron core 270.

The electromagnetic device 20 includes a plunger cap 290 made of a nonmagnetic material and having a bottomed cylindrical shape open on the upper side. The plunger cap 290 is placed between the fixed iron core 260 and the coil bobbin 220 and between the movable iron core 270 and the coil bobbin 220.

The plunger cap 290 includes a body 291 having a bottomed cylindrical shape open on the upper side, and a flange 292 having a substantially circular shape and extending outward in the radial direction from the upper end of the body 291. The body 291 of the plunger cap 290 is inserted into the insertion hole 220*a* located in the middle of the coil bobbin 220. A circular setting surface 223*a* is provided on the upper side of the coil bobbin 220 (on the upper flange 223) on which the flange 292 of the plunger cap 290 is placed.

The cylinder portion 261 of the fixed iron core 260 and the movable iron core 270 are housed in a housing space 290*a* of the plunger cap 290 placed in the cylindrical inner portion (in the insertion hole 220*a*) of the coil bobbin 220. The fixed iron core 260 is located on the opening side of the plunger cap 290, and the movable iron core 270 is located below the fixed iron core 260 inside the cylindrical plunger cap 290.

The cylinder portion 261 of the fixed iron core 260 and the movable iron core 270 are each formed into a cylindrical shape having an outer diameter which is substantially the same as the inner diameter of the plunger cap 290. The movable iron core 270 slides along the inside of the housing space 290*a* of the plunger cap 290 in the vertical direction (in the reciprocating direction: the drive-shaft direction).

In the present embodiment, the flange 292 located on the opening side of the plunger cap 290 is fixed to the periphery of an insertion hole 241*a* on the lower surface of the yoke upper plate 241. The lower bottom of the plunger cap 290 is inserted into the bushing 250 placed in the insertion hole 242*c* of the bottom wall 242*a*.

The movable iron core 270 placed on the bottom of the plunger cap 290 is magnetically connected to the periphery of the bushing 250. In other words, the bushing 250 composes a magnetic circuit together with the yoke 240 (the yoke upper plate 241 and the yoke 242), the fixed iron core 260, and the movable iron core 270.

The yoke upper plate 241 is provided in the middle with the insertion hole 241*a* into which the fixed iron core 260 is inserted. The cylinder portion 261 of the fixed iron core 260 is inserted into the insertion hole 241*a* from the upper side of the yoke upper plate 241. The yoke upper plate 241 is provided, substantially in the middle on the upper surface, with a recess 241*b* having substantially the same diameter as the flange 262 of the fixed iron core 260 to prevent the flange 262 fitted to the recess 241*b* from falling off.

A holding plate 295 made of metal is placed on the yoke upper plate 241 with right and left edges fixed to the upper surface of the yoke upper plate 241. The holding plate 295 is provided with a protrusion in the middle protruding above the upper surface of the yoke upper plate 241 so as to define the space for housing the flange 262 of the fixed iron core 260.

The holding plate 295 is provided with an insertion hole 296 into which the shaft 280 is inserted. The upper end of the shaft 280 (on the flange 282 side) extends to the contact device 30 through the insertion hole 263 of the fixed iron core 260 and the insertion hole 296 of the holding plate 295.

When the current is applied to the coil 230, the attractive force acts on the movable iron core 270 so that the movable iron core 270 moves upward to the fixed iron core 260. The shaft 280 connected and fixed to the movable iron core 270 moves upward together.

The range of movement of the movable iron core 270 is between the initial position at which the movable iron core 270 is separated from and located below the fixed iron core 260 with the gap DI provided therebetween (the position the most distant from the fixed iron core 260) and the contact position at which the movable iron core 270 is brought into contact with the fixed iron core 260 (the position the closest to the fixed iron core 260).

The return spring 297 is placed between the movable iron core 270 and the holding plate 295 to bias the movable iron core 270 by the elastic force in the direction in which the movable iron core 270 returns to the initial position (in the direction away from the fixed iron core 260). In the present embodiment, the return spring 297 is a coil spring wound on the shaft 280 and placed inside the insertion hole 263 of the fixed iron core 260.

This configuration leads the opposed surface 264 of the fixed iron core 260 opposed to the movable iron core 270 and the opposed surface 271 of the movable iron core 270 opposed to the fixed iron core 260, which are a pair of magnetic poles, to heteropolarity when the current is applied to the coil 230, so that the movable iron core 270 moves to the contact position by the attractive force. Thus, in the present embodiment, the pair of the opposed surface 264 of the fixed iron core 260 and the opposed surface 271 of the movable iron core 270 function as magnetic pole faces when the current is applied to the coil 230.

When the current applied to the coil 230 is stopped, the movable iron core 270 returns to the initial position due to the biasing force of the return spring 297.

The movable iron core 270 according to the present embodiment reciprocates to separate from the fixed iron core 260 by the gap DI when the current applied to the coil 230 is stopped and move to the fixed member 260 by the attractive force when the current is applied to the coil 230.

The contact device 30 is located above the electromagnetic device 20, and opens and closes the contact points depending on the ON/OFF operation for the application of the current to the coil 230.

The contact device 30 includes a box-shaped base 310 made of a heat resistant material such as a ceramic material and open on the lower side. The base 310 includes a ceiling 311 and a circumferential wall 312 having a substantially square column shape extending downward from the circumference of the ceiling 311.

The ceiling 311 of the base 30 is provided with two insertion holes 311*a* into which the fixed terminals 320 are inserted. The pair of (plurality of) the fixed terminals 320 is made of an electrically conductive material such as a copper material. Each of the fixed terminals 320 includes a fixed terminal body 321 having a substantially columnar shape inserted into the insertion hole 311*a* from above, and a flange 322 having a substantially disk-like shape extending outward in the radial direction from the upper end of the fixed terminal body 321 and fixed to the upper surface of the ceiling 311 (the upper surface of the circumference of the insertion hole 311*a*). The fixed contact points 321*a* are located on the bottom surfaces of the fixed contact bodies 321.

Although not shown in the drawings, a pair of terminals connected to an external load and the like is attached to the pair of the fixed terminals 320. The pair of terminals may be made of an electrically conductive material and formed into a plate shape.

The base 310 houses a movable contact 330 elongated across the pair of the fixed contact points 321*a* and including movable contact points 330*a* located on the upper surface of the movable contact 330 to face the respective fixed contact points 321*a*. Although the present embodiment exemplifies the case in which the movable contact points 330*a* are integrated with the movable contact 330, the movable contact points 330*a* may be provided separately from the movable contact 330.

The movable contact 330 is attached to the shaft (the drive shaft) 280 such that the movable contact points 330*a* are separated from and opposed to the fixed contact points 321*a* with a predetermined gap provided therebetween when the current is not applied to the coil 230. When the current is applied to the coil 230, the movable contact 330 moves upward together with the movable iron core 270 and the shaft 280, so that the movable contact points 330*a* come into contact with the fixed contact points 321*a*.

In the present embodiment, the movable iron core 270 and the movable contact 330 are arranged such that the movable contact points 330*a* and the fixed contact points 321*a* are separated from each other when the movable iron core 270 is located in the initial position and come into contact with each other when the movable iron core 270 is located in the contact position. Accordingly, the fixed terminals 320 are electrically isolated from each other when the contact device 30 is turned off during the non-conducting state of the coil 230 and electrically connected to each other when the contact device 30 is turned on during the application of the current to the coil 230.

The shaft (the drive shaft) 280 is attached to the middle of the movable contact 330 via a holder 360.

In the present embodiment, a yoke 370 is provided on the movable contact 330 so as to prevent contact welding caused by an electric arc.

More particularly, the yoke 370 includes an upper yoke (a first yoke) 371 located on the upper side of the movable contact 330 and a lower yoke (a second yoke) 372 located on the lower side of the movable contact 330.

The contact pressure between the movable contact points 330*a* and the fixed contact points 321*a* is ensured due to a pressure spring 340.

The pressure spring 340 is a coil spring of which the axial direction is parallel to the vertical direction.

The pressure spring 340 is arranged such that the upper end is inserted into an insertion hole 372*a* provided in the lower yoke (the second yoke) 372 and the lower end is fitted to a spring receiver 282*a* provided in the flange 282. The movable contact 330 is biased upward by the pressure spring 340.

The upper end of the pressure spring 340 is in contact with the lower surface 330*b* of the movable contact 330. According to the present embodiment, since the pressure spring 340 biases the movable contact 330 upward in the drive shaft direction without contact with the lower yoke 372 (the yoke 370) (without the yoke interposed therebetween), a reduction in size of the electromagnetic relay 10 (the electromagnetic device 20 and the contact device 30) in the height direction (in the vertical direction: the drive-shaft direction) can be achieved.

Further, in the present embodiment, gas is sealed in the base 310 in order to prevent the occurrence of an electric arc between the movable contact points 330*a* and the fixed contact points 321*a* when the movable contact points 330*a* are separated from the fixed contact points 321*a*. The gas used may be mixed gas mainly including hydrogen gas superior in heat conductivity in the temperature range in which an electric are occurs. In the present embodiment, an upper flange 380 covering the gap between the base 310 and the yoke upper plate 241 is provided so as to seal the gas.

More particularly, the base 310 includes the ceiling 311 provided with the pair of the aligned insertion holes 311*a* and the circumferential wall 312 having a square column shape extending downward from the circumference of the ceiling 311, and is formed into a hollow box shape open on the lower side (on the movable contact 330 side), as described above. The base 310 is fixed to the yoke upper plate 241 via the upper flange 380 with the movable contact 330 housed inside the circumferential wall 312 from the opening on the lower side.

The circumference of the opening on the lower side of the base 310 is preferably airtightly connected to the upper surface of the upper flange 380 by silver brazing. In addition, the lower surface of the upper flange 380 is preferably airtightly connected to the upper surface of the yoke upper plate 241 by arc welding or the like. Further, the lower surface of the yoke upper plate 241 is preferably airtightly connected to the flange 292 of the plunger cap 290 by arc welding or the like. Accordingly, the seal space S for sealing the gas can be provided in the base 310.

A capsule yoke block is preferably used in addition to the gas in order to prevent the occurrence of an electric arc. The capsule yoke block may be composed of a capsule yoke having a substantially U-shape and made of a magnetic material such as iron, and a pair of permanent magnets.

An insulating member 350 is also provided in the opening of the base 310 in order to insulate the connected portion between the base 310 and the upper flange 380 against an electric are caused between the fixed contact points 321*a* and the movable contact points 330*a*.

The insulating member 350 has a substantially rectangular cuboid open on the upper side and made of an insulating material such as a ceramic material and synthetic resin, and includes a bottom wall 351 and a circumferential wall 352 extending upward from the circumference of the bottom wall 351. The upper end of the upper flange 380 is brought into contact with the circumferential wall 352 on the upper side. The insulating member 350 thus insulates the connected portion between the base 310 and the upper flange 380 from the contact points of the fixed contact points 321*a* and the movable contact points 330*a*.

The bottom wall 351 of the insulating member 350 is provided with an insertion hole 351*a* into which the shaft 280 is inserted.

Next, the operation of the electromagnetic relay 10 (the electromagnetic device 20 and the contact device 30) is described below.

When the current applied to the coil 230 is stopped, the movable iron core 270 moves in the direction away from the fixed iron core 260 due to the elastic force of the return spring 297, so that the movable contact points 330*a* are separated from the fixed contact points 321*a*, as shown in FIG. 1 and FIG. 2.

When the coil 230 is switched from the off state to the conducting state, the movable iron core 270 moves upward (toward the fixed iron core 260) due to the electromagnetic force and comes closer to the fixed iron core 260 against the elastic force of the return spring 297. In association with the upward movement of the movable iron core 270 (toward the fixed iron core 260), the shaft 280, and the upper yoke 371, the movable contact 330, the lower yoke 372 and the holder 360 attached to the shaft 280 move upward (toward the fixed contact points 321*a*). As a result, the movable contact points 330*a* of the movable contact 330 are brought into contact with and electrically connected to the fixed contact points 321*a* of the fixed terminals 320, so that the electromagnetic relay 10 (the electromagnetic device 20 and the contact device 30) is turned on.

The electromagnetic relay 10 according to the present embodiment improves the attractive force acting on the movable iron core 270 for moving toward the fixed iron core 260.

In particular, a permanent magnet 40 for generating second magnetic flux M2 is used to improve the attractive force acting on the movable iron core 270 for moving toward the fixed iron core 260.

Figure 3:
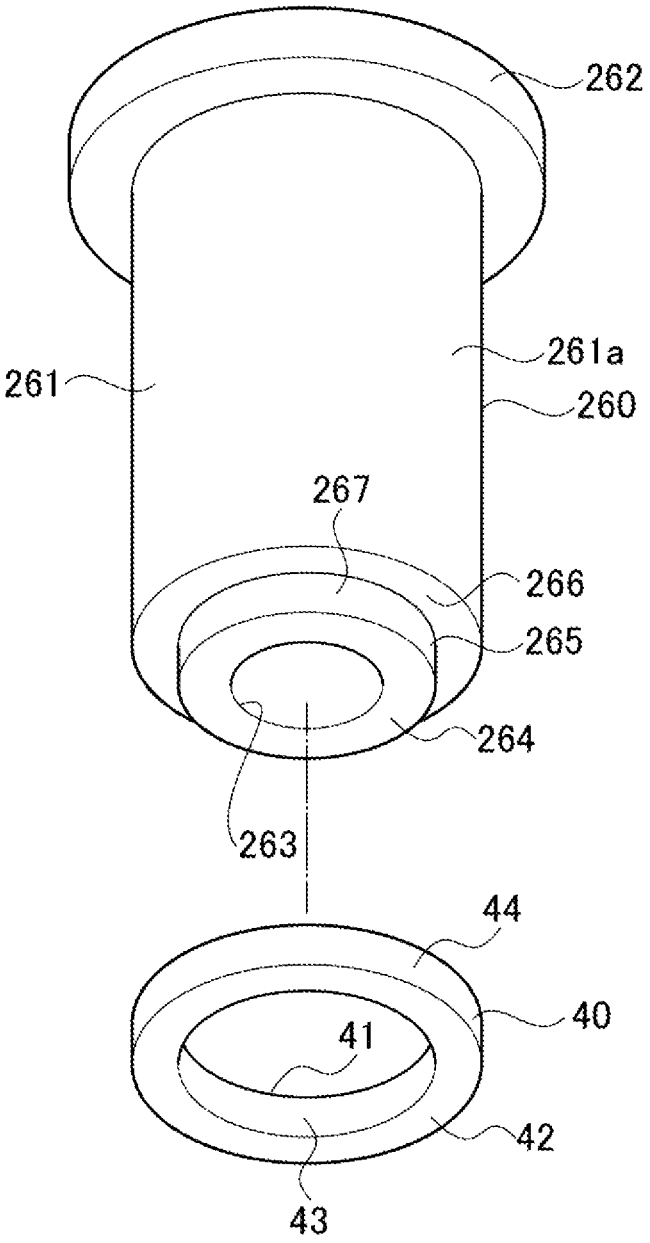
FIG. 3 is a perspective view of a plunger cap and a permanent magnet according to the first embodiment of the present invention.

The present embodiment uses the circular (ring-shaped) permanent magnet 40 having a rectangular shape in cross section, as shown in FIG. 2 and FIG. 3. The permanent magnet 40 has an upper surface 41 and a lower surface 42 serving as magnetized surfaces opposed to each other in the penetration direction conforming to the vertical direction. FIG. 4 illustrates the permanent magnet 40 arranged in the state in which the upper surface 41 serves as the S-pole and the lower surface 42 serves as the N-pole.

The circular permanent magnet 40 is placed on the fixed iron core 260 (at least one of the fixed iron core 260 and the movable iron core 270), as shown in FIG. 3.

In particular, the circular permanent magnet 40 is inserted and fixed to a groove 265 provided along the entire circumference of the bottom of the fixed iron core 260. In the present embodiment, the permanent magnet 40 is fixed to the fixed iron core 260 in the state in which the upper surface 41 and the inner surface 43 are respectively brought into contact with a recessed surface 266 and a side surface 267 of the groove 265. The permanent magnet 40 may be fixed to the fixed iron core 260 by any conventional method such as fitting and adhesion.

This arrangement of the permanent magnet 40 leads the direction in which the paired magnetized surfaces (the upper surface 41 and the lower surface 42) of the permanent magnet 40 are opposed into conforming to the vertical direction (the reciprocating direction of the movable iron core 270).

In the present embodiment, the direction of the second magnetic flux M2 between the opposed surfaces (the opposed surface 264 and the opposed surface 271) of the fixed iron core 260 and the movable iron core 270 conforms to the direction of the first magnetic flux M1 between the opposed surfaces (the opposed surface 264 and the opposed surface 271) of the fixed iron core 260 and the movable iron core 270 (in FIG. 4, the upward direction).

The lower surface (the magnetized surface) 42 of the permanent magnet 40 is opposed and exposed to the opposed surface 271 of the movable iron core (the other iron core) 270.

Further, in the present embodiment, the lower surface (the magnetized surface) 42 of the permanent magnet 40 is on the same plane as the opposed surface 264 of the fixed iron core 260 (the iron core to which the permanent magnet 40 is attached). The outer surface 44 of the permanent magnet 40 is on the same plane as the outer surface of the fixed iron core 260 (as the outer surface 261*a* of the cylinder portion 261).

According to the present embodiment, the permanent magnet 40 is placed on at least one of the fixed iron core 260 and the movable iron core 270 such that the magnetized surface 42 or 41 is opposed and exposed to the opposed surface 271 or 264 of the other iron core 270 or 260. As compared with the case shown in FIG. 5, the present embodiment can allow the magnetic flux (the second magnetic flux M2) generated by the permanent magnet 40 to flow through the opposed surfaces more efficiently, as shown in FIG. 4.

Figure 5:
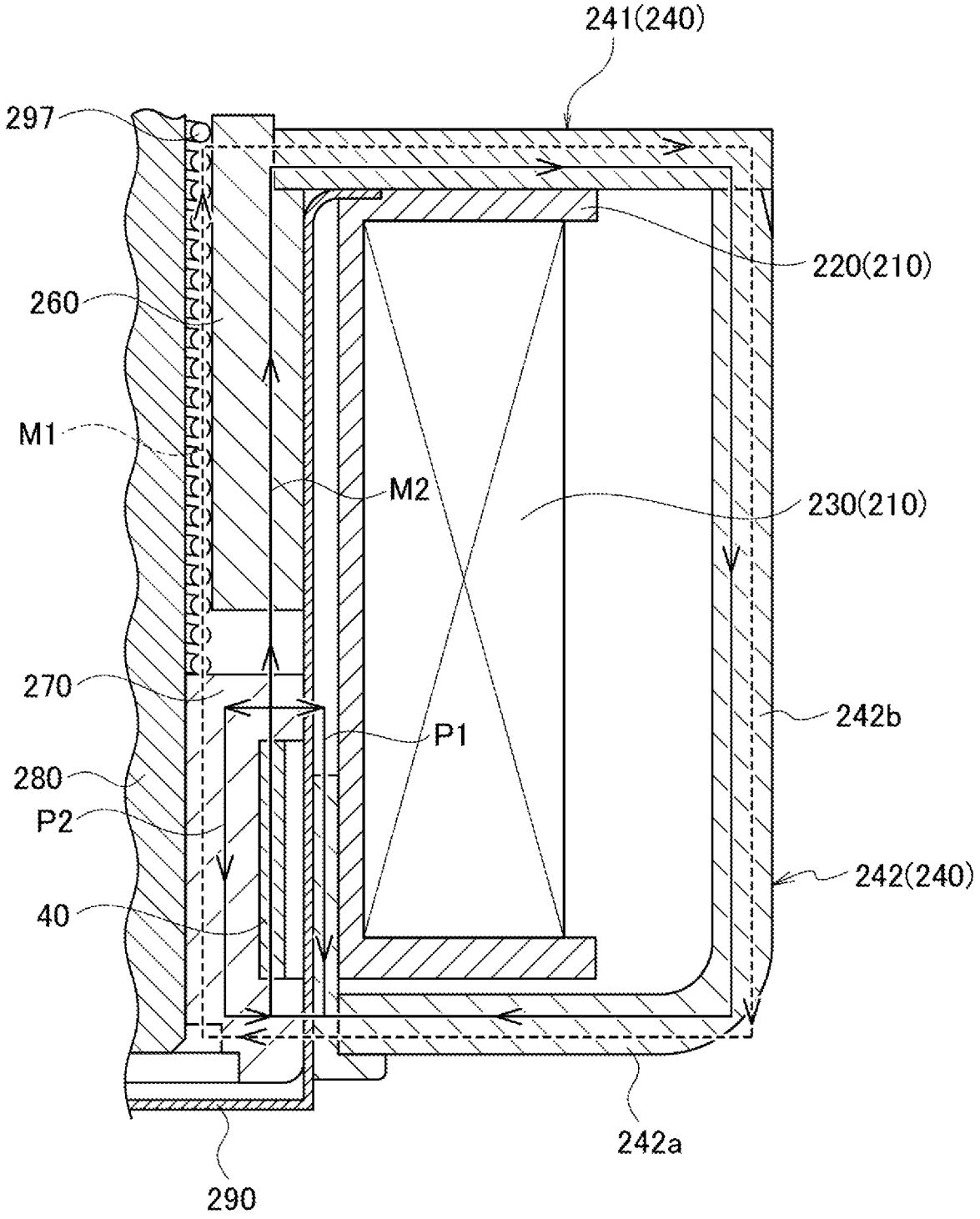
FIG. 5 is a view for schematically illustrating a flow of a magnetic flux generated in an electromagnetic relay according to a comparative example.

FIG. 5 illustrates the structure in which the permanent magnet 40 is arranged on the outer side in the middle of the movable iron core 270 in the vertical direction (in the reciprocating direction of the movable iron core 270). This structure results in two routes, as described below, through which the magnetic flux (the second magnetic flux M2) generated by the permanent magnet 40 flows, since the permanent magnet 40 is not exposed to the opposed surface 264 of the fixed iron core 260.

As shown in FIG. 5, the first route P1 makes a loop passing through the upper portion of the permanent magnet 40, the outer upper portion of the movable iron core 270, the upper portion of the bushing 250, the lower portion of the bushing 250, the outer lower portion of the movable iron core 270, and the lower portion of the permanent magnet 40, and returning to the upper portion of the permanent magnet 40.

The second route P2 makes a loop passing through the upper portion of the permanent magnet 40, the outer upper portion of the movable iron core 270, the inner upper portion of the movable iron core 270, the inner lower portion of the movable iron core 270, the outer lower portion of the movable iron core 270, and the lower portion of the permanent magnet 40, and returning to the upper portion of the permanent magnet 40.

Since the first route P1 or the second route P2 does not pass across the opposed surfaces (the opposed surface 264 and the opposed surface 271), the amount of the magnetic flux (the second magnetic flux M2) generated by the permanent magnet 40 and flowing through the opposed surfaces (the opposed surface 264 and the opposed surface 271) tends to decrease. Namely, the magnetic flux (the second magnetic flux M2) generated by the permanent magnet 40 contributing to improving the attractive force acting on the movable iron core 270 for moving toward the fixed iron core 260 is reduced.

In the present embodiment, as shown in FIG. 4, the magnetic flux (the second magnetic flux M2) generated by the permanent magnet 40 and passing along the route at least on the iron core side flows through the opposed surfaces (the opposed surface 264 and the opposed surface 271). Accordingly, the efficiency of the magnetic flux (the second magnetic flux M2) generated by the permanent magnet 40 and flowing through the opposed surfaces can be improved, so as to increase the amount of the magnetic flux contributing to improving the attractive force acting on the movable iron core 270 for moving toward the fixed iron core 260.

As described above, the electromagnetic device 20 according to the present embodiment includes the coil 230 which generates the first magnetic flux M1 when a current is applied thereto, the fixed iron core 260 through which the first magnetic flux M1 flows, and the movable iron core 270 which reciprocates to separate from the fixed iron core 260 by the gap DI when the current applied to the coil 230 is stopped and move to the fixed member 260 by the attractive force when the current is applied to the coil 230.

The electromagnetic device 20 further includes the permanent magnet 40 which generates the second magnetic flux M2 in the same direction as the first magnetic flux M1 between the opposed surfaces 264 and 271 of the fixed iron core 260 and the movable iron core 270.

The permanent magnet 40 is placed on at least one of the fixed iron core 260 and the movable iron core 270 such that the magnetized surface 42 or 41 is opposed and exposed to the opposed surface 271 or 264 of the other iron core 270 or 260.

Accordingly, the efficiency of the magnetic flux (the second magnetic flux M2) generated by the permanent magnet 40 and flowing through the opposed surfaces can be improved, so as to increase the attractive force acting on the movable iron core 270 for moving toward the fixed iron core 260.

In the present embodiment, the permanent magnet 40 is formed into a ring shape.

Since the magnetic flux (the second magnetic flux M2) is generated along the entire permanent magnet 40, the amount of the magnetic flux (the second magnetic flux M2) flowing through the opposed surfaces can be increased. Further, since the magnetic flux (the second magnetic flux M2) generated by the permanent magnet 40 flows through the entire circumference of the opposed surfaces, the magnetic flux between the opposed surfaces can be equalized. Accordingly, the direction of the attractive force acting on the movable iron core 270 for moving toward the fixed iron core 260 can be prevented from inclining with respect to the reciprocating direction of the movable iron core 270, so that the movable iron core 270 can reciprocate more smoothly.

In the present embodiment, the magnetized surface 42 or 41 of the permanent magnet 40 is on the same plane as the opposed surface 264 or 271 of the iron core 260 or 270.

Since the magnetized surfaces (the upper surface 41 and the lower surface 42) of the permanent magnet 40 are brought closer to the fixed iron core 260 or the movable iron core 270, the magnetic flux (the second magnetic flux M2) generated by the permanent magnet 40 can flow through the opposed surfaces more efficiently. Accordingly, the attractive force acting on the movable iron core 270 for moving toward the fixed iron core 260 can further be improved.

The electromagnetic relay 10 according to the present embodiment is equipped with the electromagnetic device 20.

The present embodiment can provide the electromagnetic device 20 with the improved attractive force acting on the movable iron core 270 for moving toward the fixed iron core 260, and can provide the electromagnetic relay 10 equipped with the electromagnetic device 20.

Second Embodiment

Figure 6:
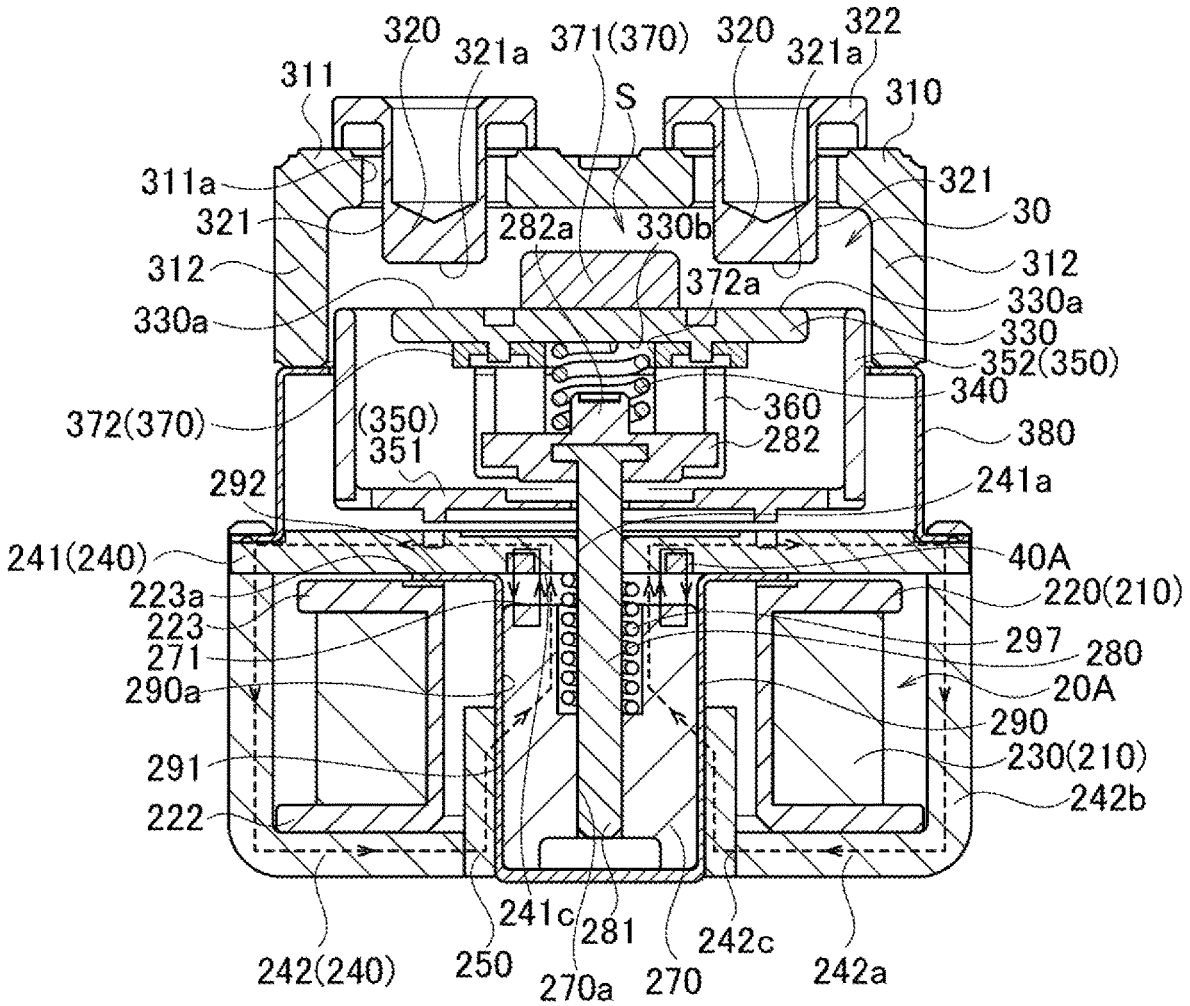
FIG. 6 is a cross-sectional view of a contact device and an electromagnetic device according to a second embodiment of the present invention.

An electromagnetic device 20A according to the present embodiment differs from the electromagnetic device 20 in excluding the fixed iron core, as shown in FIG. 6. The other configurations are the same as those of the electromagnetic device 20. The electromagnetic relay 10 is equipped with this electromagnetic device 20A. Namely, the electromagnetic relay 10 includes the electromagnetic device 20A located on the lower side and the contact device 30 located on the upper side.

The present embodiment uses the yoke upper plate 241 to serve as a fixed member instead of the fixed iron core. In other words, the electromagnetic device 20A according to the present embodiment includes the yoke upper plate (the fixed member) 241 which is magnetized by the coil 230 applied with the current (allows the first magnetic flux M1 to flow therethrough), and the movable iron core (the movable member) 270 which is opposed to the yoke upper plate 241 in the vertical direction (in the shaft direction) and placed in the cylindrical inner portion (in the insertion hole 220*a*) of the coil bobbin 220.

The yoke upper plate (the fixed member) 241 is provided in the middle with the insertion hole 241*a* into which the shaft 280 is inserted. The return spring 297 is placed between the movable iron core 270 and the yoke upper plate (the fixed member) 241 to bias the movable iron core 270 due to the elastic force in the direction in which the movable iron core 270 returns to the initial position (in the direction away from the yoke upper plate (the fixed member) 241).

The electromagnetic device 20A can also improve the attractive force acting on the movable iron core (the movable member) 270 for moving toward the yoke upper plate (the fixed member) 241.

In particular, the attractive force acting on the movable iron core (the movable member) 270 for moving toward the yoke upper plate (the fixed member) 241 can be improved by use of the second magnetic flux M2 generated by a permanent magnet 40A.

Figure 7:
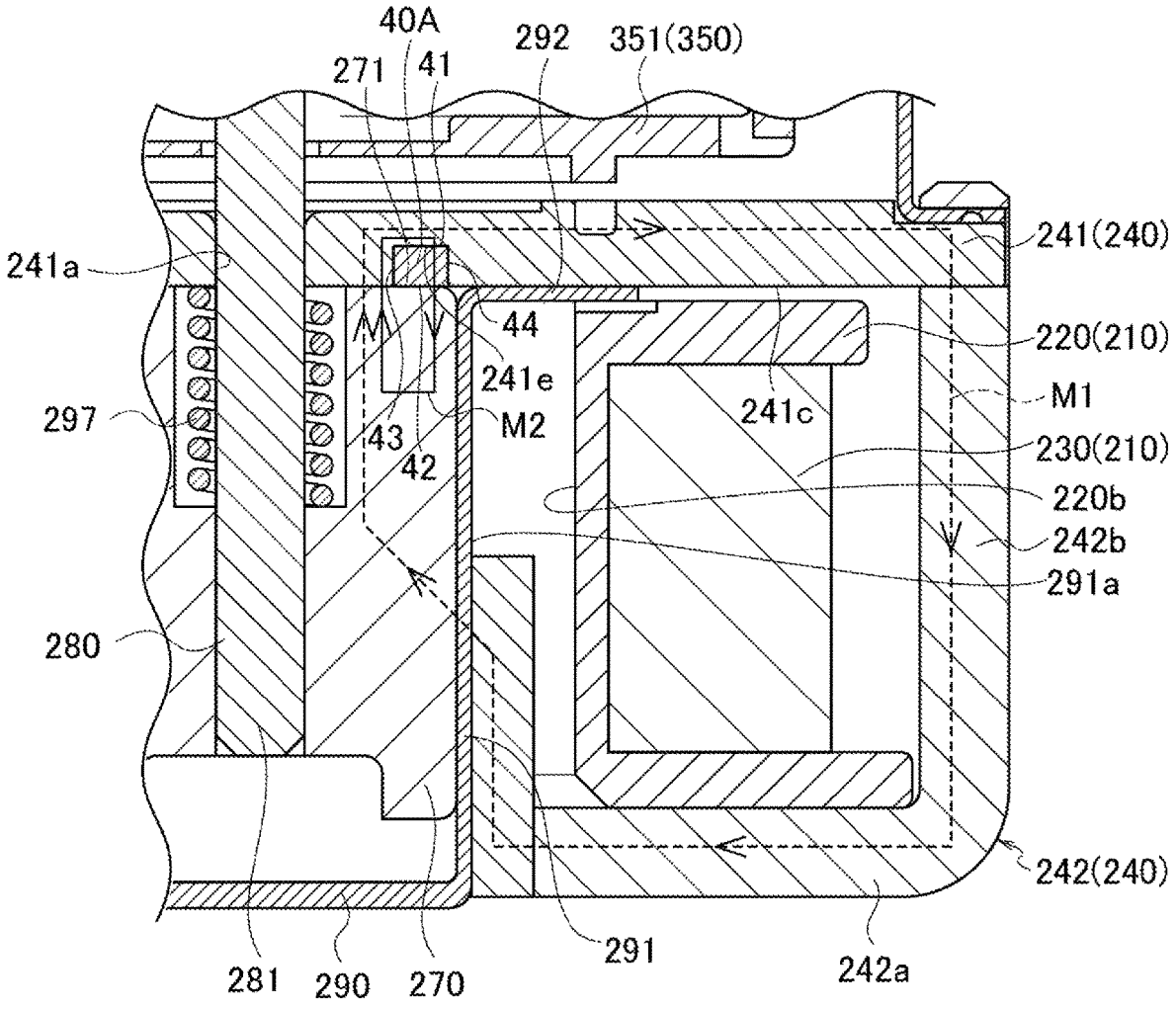
FIG. 7 is a view for schematically illustrating a flow of a magnetic flux generated in an electromagnetic relay according to the second embodiment of the present invention.

The present embodiment uses the circular (ring-shaped) permanent magnet 40A having a substantially rectangular shape in cross section, as shown in FIG. 6 and FIG. 7. The permanent magnet 40A has the upper surface 41 and the lower surface 42 serving as magnetized surfaces opposed to each other in the penetration direction conforming to the vertical direction. FIG. 7 illustrates the permanent magnet 40A arranged in the state in which the upper surface 41 serves as the S-pole and the lower surface 42 serves as the N-pole.

The circular permanent magnet 40A is arranged in the upper yoke plate (the fixed member: at least one of the fixed member and the movable member) 241, as shown in FIG. 7.

In particular, the circular permanent magnet 40A is inserted and fixed to a groove 241*e* provided along the entire circumference of the insertion hole 241*a* on the lower side of the yoke upper plate (the fixed member) 241. In the present embodiment, the permanent magnet 40A is fixed to the yoke upper plate (the fixed member) 241 in the state in which the upper surface 41, the inner surface 43, and the outer surface 44 are brought into contact with the recessed surface and the side surfaces of the groove 241*e*. The permanent magnet 40A may be fixed to the yoke upper plate (the fixed member) 241 by any conventional method such as fitting and adhesion.

This arrangement of the permanent magnet 40A leads the direction in which the paired magnetized surfaces (the upper surface 41 and the lower surface 42) of the permanent magnet 40A are opposed into conforming to the vertical direction (the reciprocating direction of the movable iron core 270).

In the present embodiment, the direction of the second magnetic flux M2 between the opposed surfaces (the opposed surface 241*c* and the opposed surface 271) of the yoke upper plate (the fixed member) 241 and the movable iron core 270 conforms to the direction of the first magnetic flux M1 between the opposed surfaces (the opposed surface 241*c* and the opposed surface 271) of the yoke upper plate (the fixed member) 241 and the movable iron core 270 (in FIG. 7, the upward direction).

The lower surface (the magnetized surface) 42 of the permanent magnet 40A is opposed and exposed to the opposed surface 271 of the movable iron core (the other member) 270.

Further, in the present embodiment, the lower surface (the magnetized surface) 42 of the permanent magnet 40A is on the same plane as the opposed surface 241*c* of the yoke upper plate (the fixed member) 241 (the member to which the permanent magnet 40A is attached).

According to the present embodiment, the permanent magnet 40A is placed in at least one of the yoke upper plate (the fixed member) 241 and the movable iron core (the movable member) 270 such that the magnetized surface 42 or 41 is opposed and exposed to the opposed surface 271 or 241*c* of the other member 270 or 241.

The present embodiment described above can also achieve the similar advantageous effects as the first embodiment.

Figure 8:
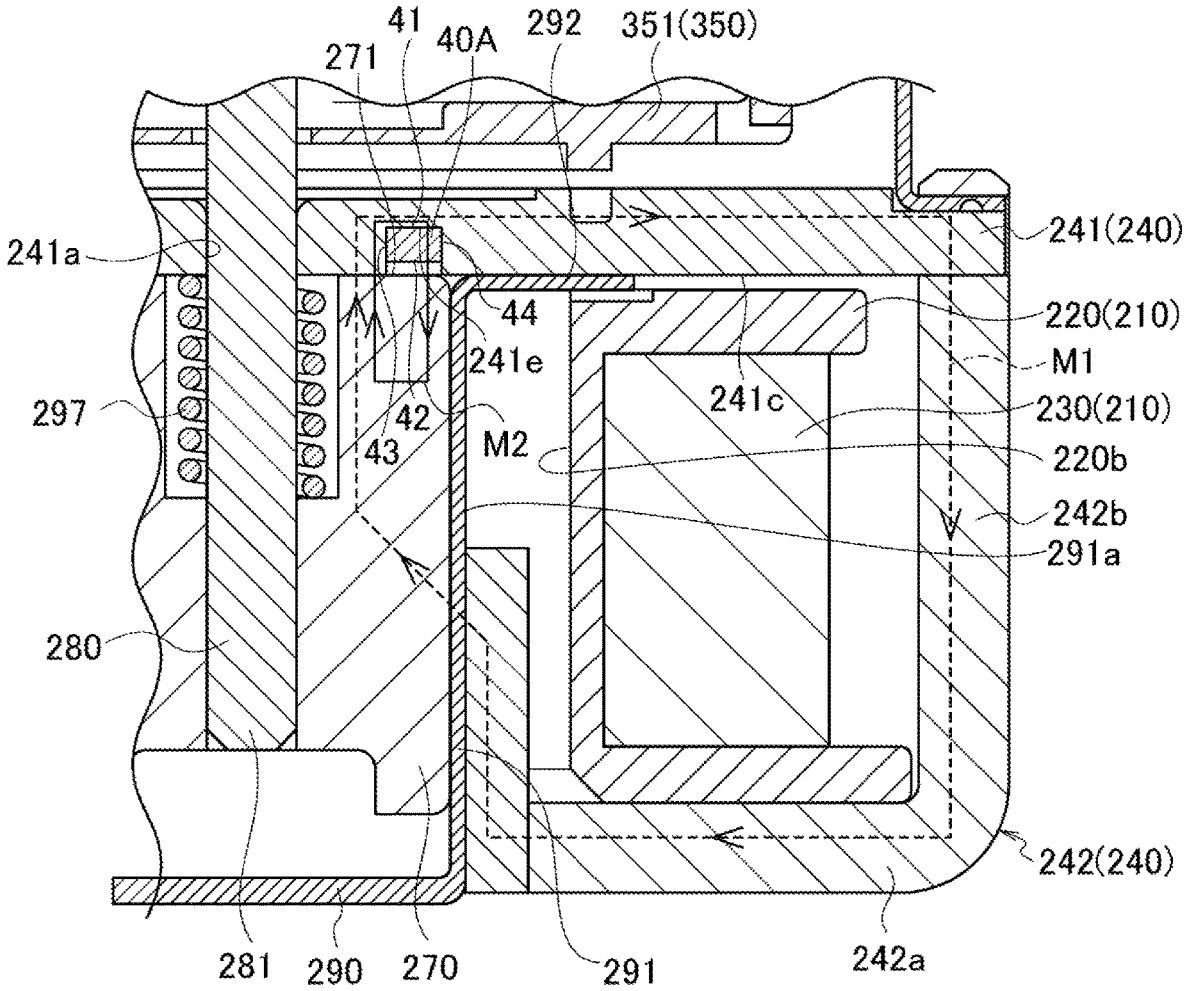
FIG. 8 is a view for schematically illustrating a flow of a magnetic flux generated in an electromagnetic relay according to a modified example of the second embodiment of the present invention.

Alternatively, as shown in FIG. 8, the permanent magnet 40A may be arranged such that the lower surface (the magnetized surface) 42 is located above the opposed surface 241*c* of the yoke upper plate (the fixed member) 241 (the member to which the permanent magnet 40A is attached). In other words, a gap may be provided between the lower surface 42 and the opposed surface 271 when the opposed surface 241*c* of the yoke upper plate (the fixed member) 241 is in contact with the opposed surface 271 of the movable iron core 270.

This arrangement can also increase the magnetic flux (the second magnetic flux M2) generated by the permanent magnet 40A and flowing through the opposed surfaces more efficiently, so as to further improve the attractive force acting on the movable iron core (the movable member) 270 for moving toward the yoke upper plate (the fixed member) 241.

This arrangement can also prevent damage to the permanent magnet 40A since the lower surface 42 is not brought into contact with the opposed surface 271 when the current is applied to the coil 230.

Third Embodiment

Figure 9:
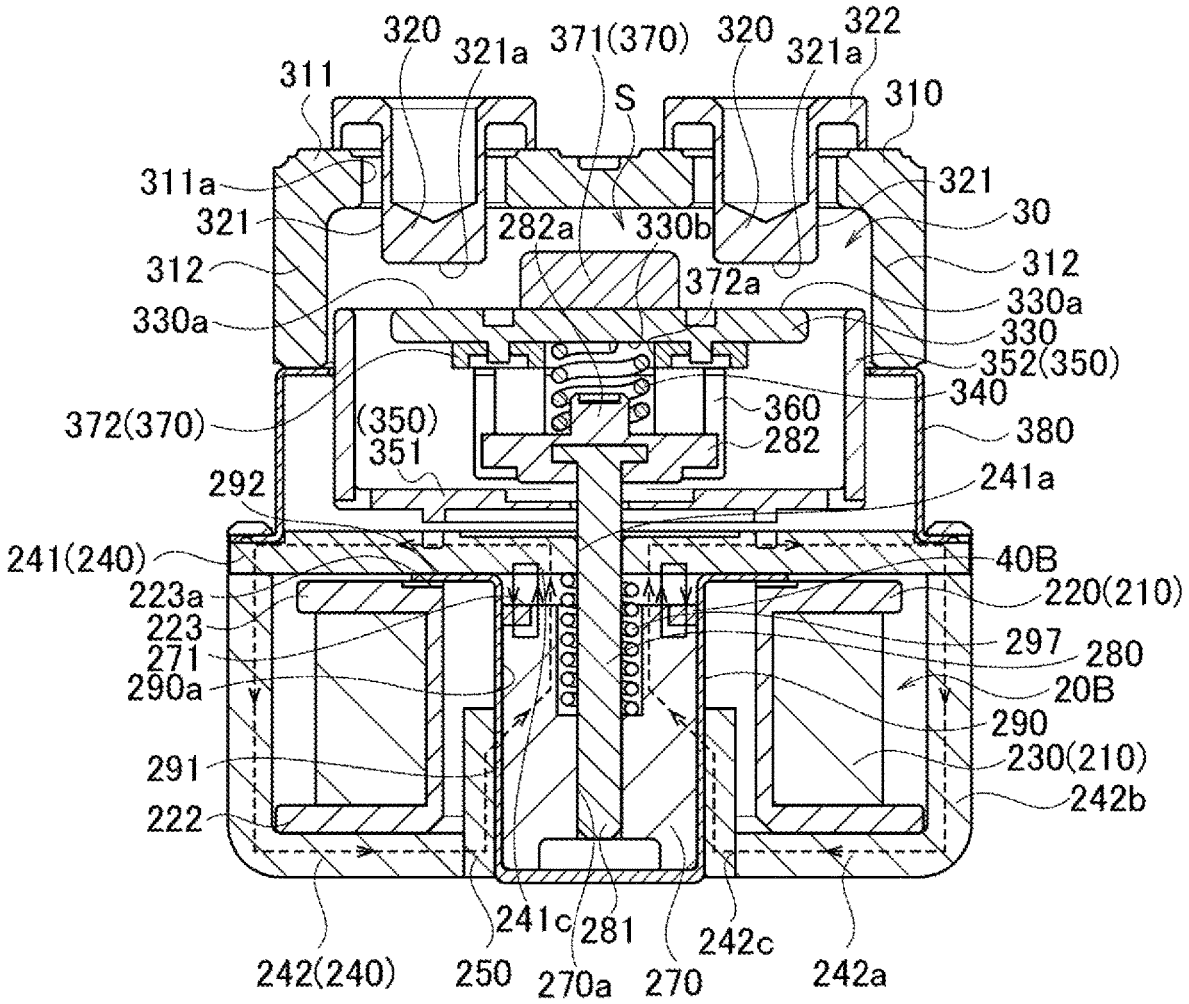
FIG. 9 is a cross-sectional view of a contact device and an electromagnetic device according to a third embodiment of the present invention.

An electromagnetic device 20B according to the present embodiment has substantially the same structure as the electromagnetic device 20A described in the second embodiment, as shown in FIG. 9.

In the present embodiment, a circular permanent magnet 40B is arranged in the movable iron core (the movable member: at least one of the fixed member and the movable member) 270, as shown in FIG. 9 and FIG. 0.

In particular, the circular permanent magnet 40B is inserted and fixed to a groove 270*b* provided along the entire circumference of the insertion hole 270*a* on the upper side of the movable iron core (the movable member) 270. In the present embodiment, the permanent magnet 40B is fixed to the movable iron core (the movable member) 270 in the state in which the lower surface 42 and the inner surface 43 are respectively brought into contact with the recessed surface and the side surface of the groove 270*b*. The permanent magnet 40B may be fixed to the movable iron core (the movable member) 270 by any conventional method such as fitting and adhesion.

This arrangement of the permanent magnet 40B leads the direction in which the paired magnetized surfaces (the upper surface 41 and the lower surface 42) of the permanent magnet 40B are opposed into conforming to the vertical direction (the reciprocating direction of the movable iron core 270).

Figure 10:
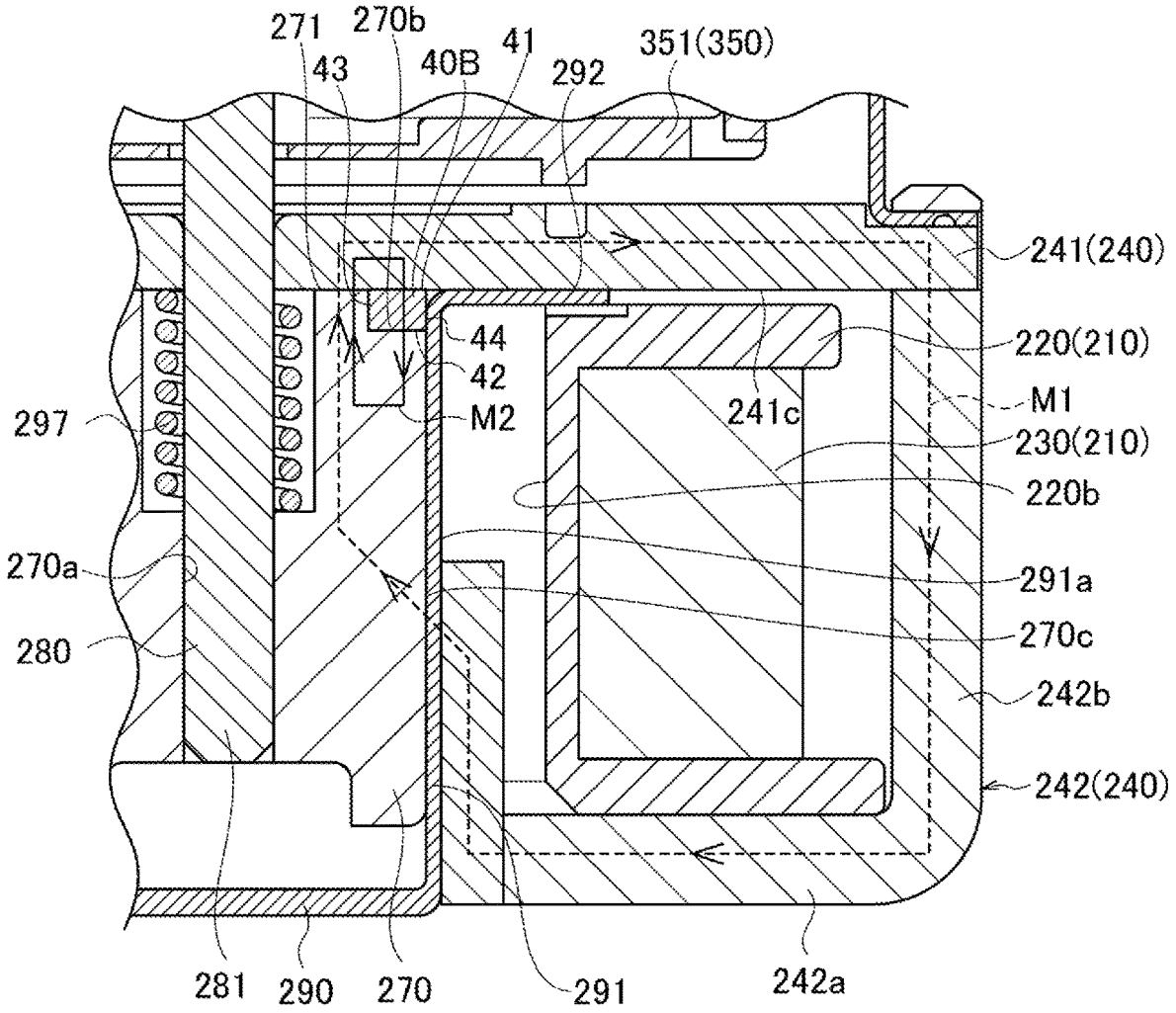
FIG. 10 is a view for schematically illustrating a flow of a magnetic flux generated in an electromagnetic relay according to the third embodiment of the present invention.

In the present embodiment, the direction of the second magnetic flux M2 between the opposed surfaces (the opposed surface 241*c* and the opposed surface 271) of the yoke upper plate (the fixed member) 241 and the movable iron core 270 conforms to the direction of the first magnetic flux M1 between the opposed surfaces (the opposed surface 241*c* and the opposed surface 271) of the yoke upper plate (the fixed member) 241 and the movable iron core 270 (in FIG. 10, the upward direction).

The upper surface (the magnetized surface) 41 of the permanent magnet 40B is opposed and exposed to the opposed surface 241*c* of the yoke upper plate (the fixed member the other member) 241.

Further, in the present embodiment, the upper surface (the magnetized surface) 41 of the permanent magnet 40B is on the same plane as the opposed surface 271 of the movable iron core 270 (the movable member the member to which the permanent magnet 40B is attached). The outer surface 44 of the permanent magnet 40B is on the same plane as the outer surface 270*c* of the movable iron core 270.

According to the present embodiment, the permanent magnet 40B is placed in at least one of the yoke upper plate (the fixed member) 241 and the movable iron core (the movable member) 270 such that the magnetized surface 41 or 42 is opposed and exposed to the opposed surface 241*c* or 271 of the other member 241 or 270.

The present embodiment described above can also achieve the similar advantageous effects as the first embodiment.

Figure 11:
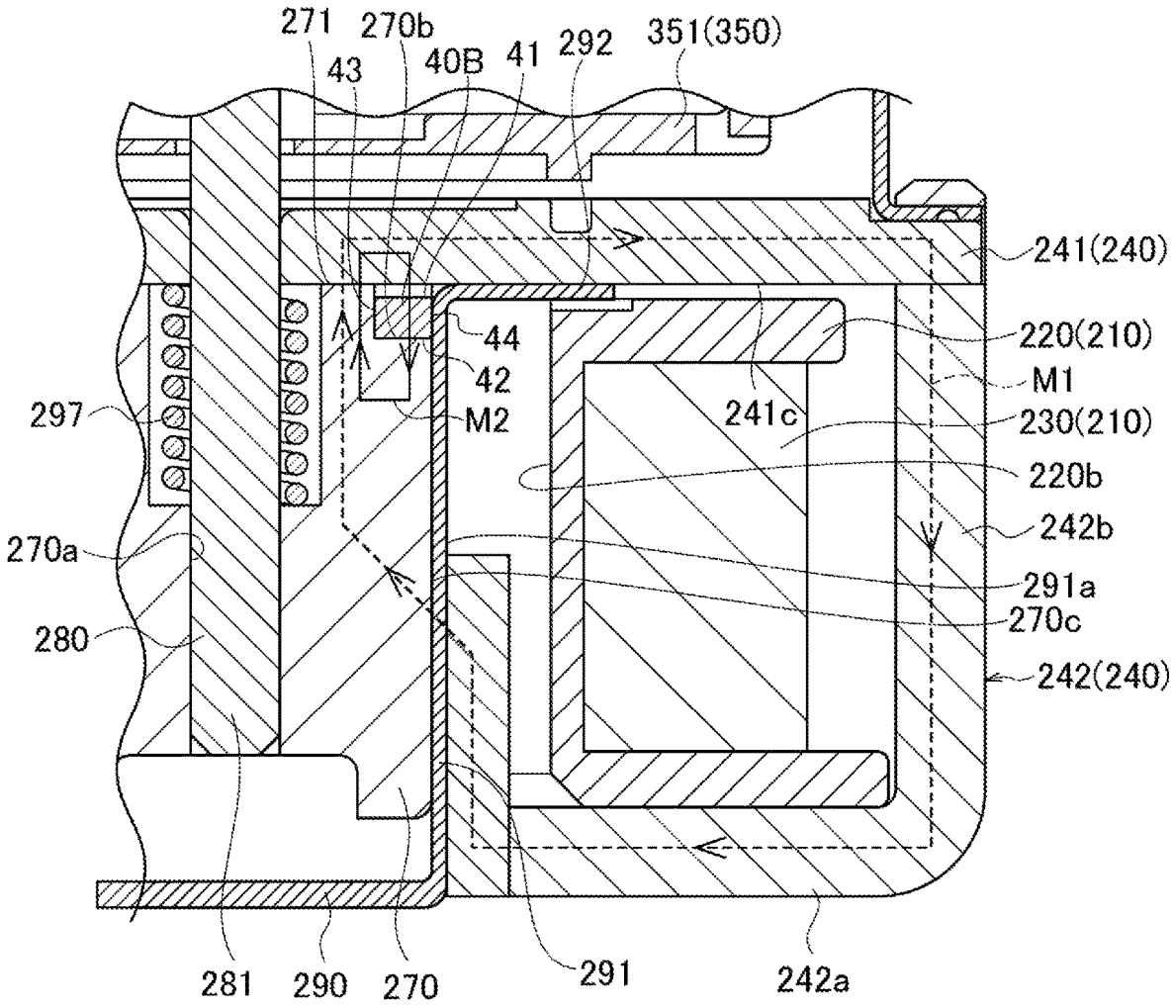
FIG. 11 is a view for schematically illustrating a flow of a magnetic flux generated in an electromagnetic relay according to a modified example of the third embodiment of the present invention.

Alternatively, as shown in FIG. 11, the permanent magnet 40B may be arranged such that the upper surface (the magnetized surface) 41 is located below the opposed surface 271 of the movable iron core 270 (the movable member: the member to which the permanent magnet 40B is attached). In other words, a gap may be provided between the upper surface 41 and the opposed surface 241*c* of the yoke upper plate (the fixed member) 241 when the opposed surface 241*c* is in contact with the opposed surface 271 of the movable iron core 270.

This arrangement can also increase the magnetic flux (the second magnetic flux M2) generated by the permanent magnet 40B and flowing through the opposed surfaces more efficiently, so as to further improve the attractive force acting on the movable iron core 270 for moving toward the yoke upper plate (the fixed member) 241.

This arrangement can also prevent damage to the permanent magnet 40B since the upper surface 41 is not brought into contact with the opposed surface 241*c* when the current is applied to the coil 230.

Fourth Embodiment

An electromagnetic device 20C according to the present embodiment has substantially the same structure as the electromagnetic device 20 described in the first embodiment. An electromagnetic relay 10C is equipped with the electromagnetic device 20C. The electromagnetic relay 10C includes the electromagnetic device 20C located on the lower side and a contact device 30C located on the upper side.

Figure 12:
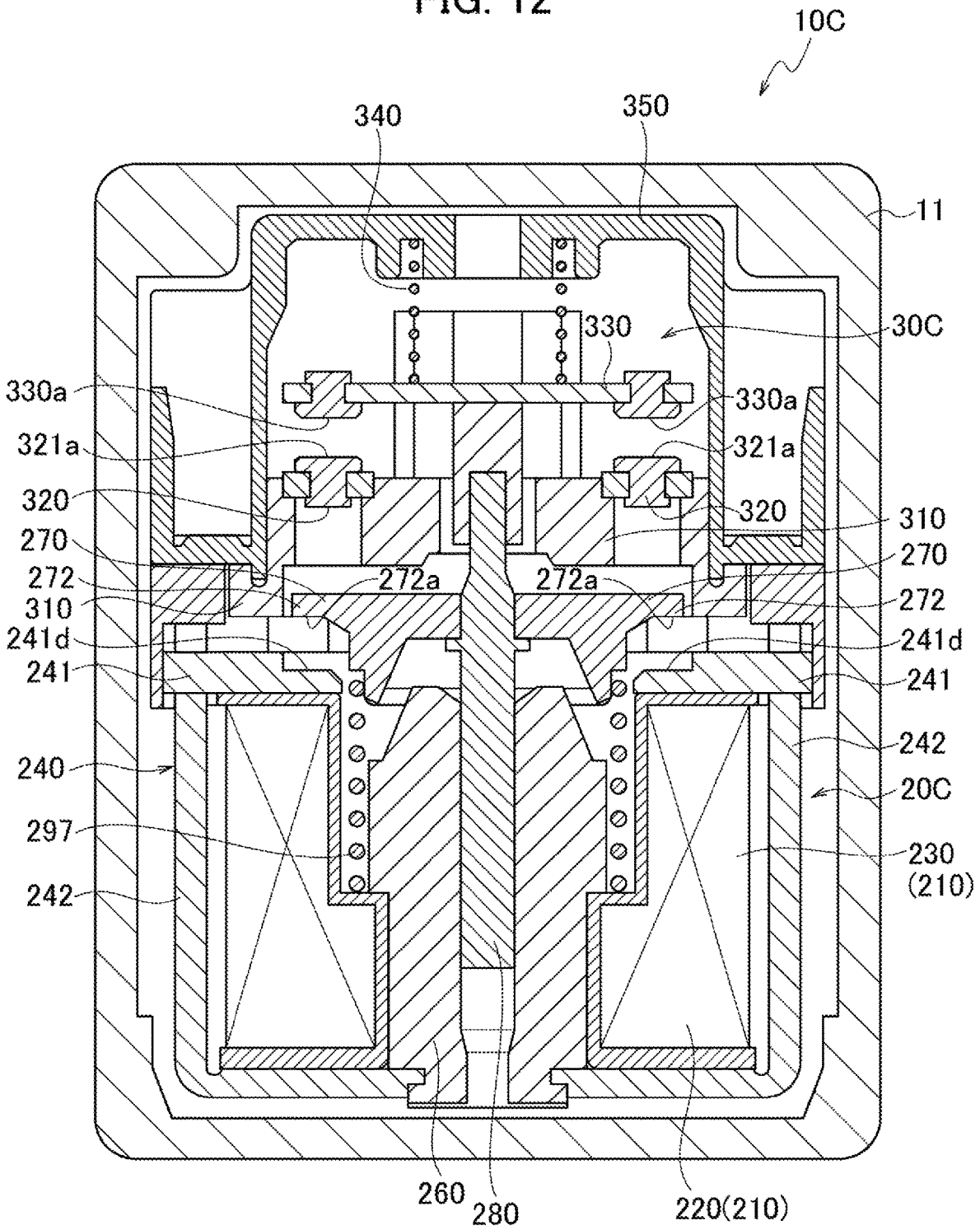
FIG. 12 is a cross-sectional view showing a fundamental structure of an electromagnetic relay according to a fourth embodiment of the present invention.

As shown in FIG. 12, the electromagnetic device 20C according to the present embodiment differs from the electromagnetic device 20 in that the fixed iron core 260 is located on the lower side and the movable iron core 270 is located on the upper side. The contact device 30C according to the present embodiment includes the movable contact 330 having the movable contact points 330*a* located above the fixed terminals 320 having the fixed contact points 321*a*. The movable contact points 330*a* are brought into contact with the contact points 321*a* when the movable contact 330 fixed to the movable iron core 270 via the shaft 280 moves downward (toward the electromagnetic device).

In the electromagnetic device 20C according to the present embodiment, the movable iron core 270 includes a flange 272 which is opposed to the yoke upper plate (the fixed member) 241 in the vertical direction (in the shaft direction) magnetized by the coil 230 applied with the current (allowing the first magnetic flux M1 to flow therethrough). The lower surface 272*a* of the flange 272 and the upper surface 241*d* of the yoke upper plate (the fixed member) 241 opposed to each other serve as opposed surfaces.

The opposed surfaces of the movable iron core 270 and the fixed iron core 260 further extend in the direction intersecting the horizontal plane. The extending surfaces reduce the air gap between the opposed surfaces between the movable iron core 270 and the fixed iron core 260, so as to increase the electromagnetic attractive force immediately after starting the application of the current to the coil 230.

The electromagnetic device 20C can also improve the attractive force acting on the movable iron core (the movable member) 270 for moving toward the yoke upper plate (the fixed member) 241.

Figure 13:
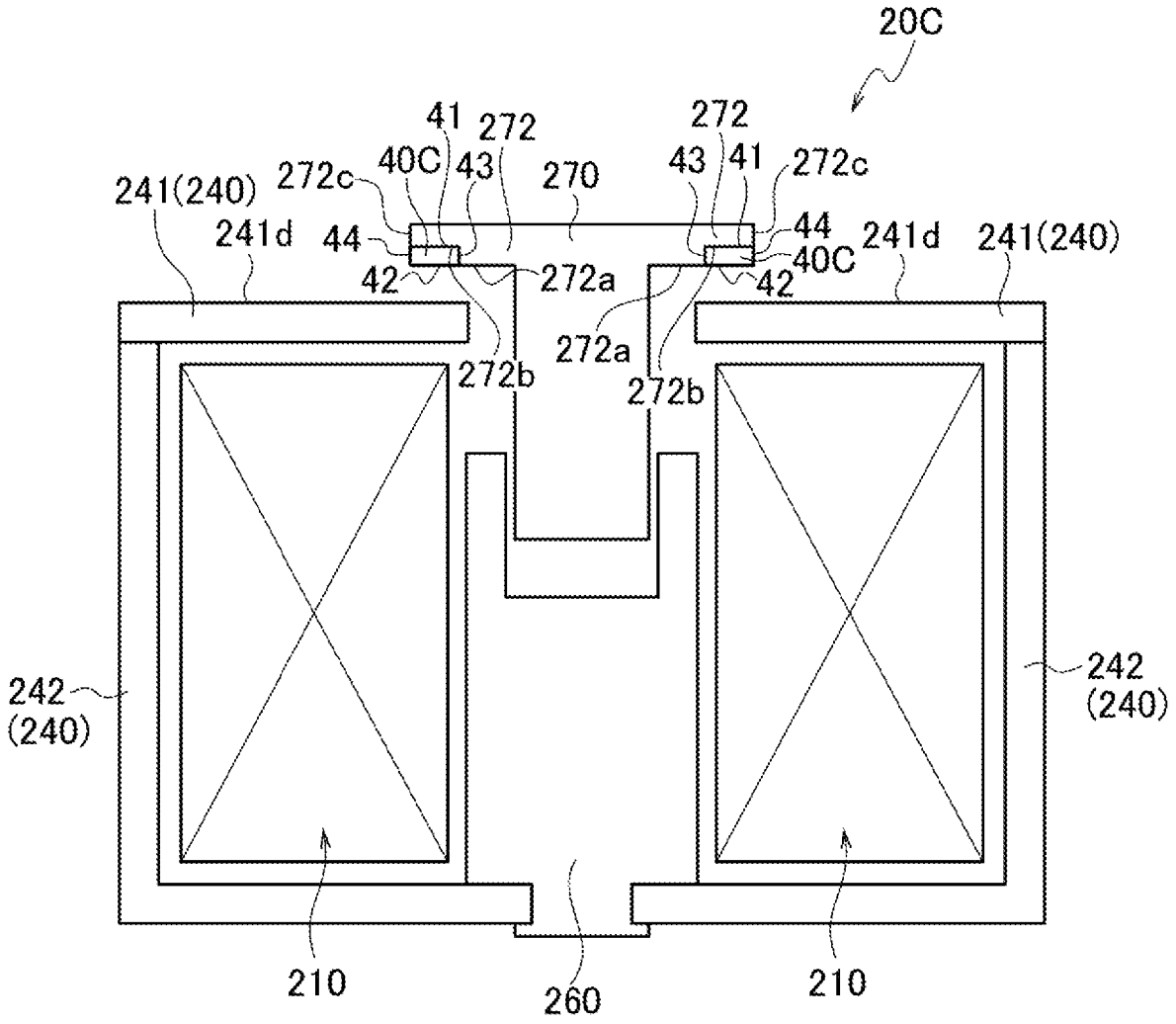
FIG. 13 is a schematic view of an electromagnetic device according to the fourth embodiment of the present invention.
Figure 14:
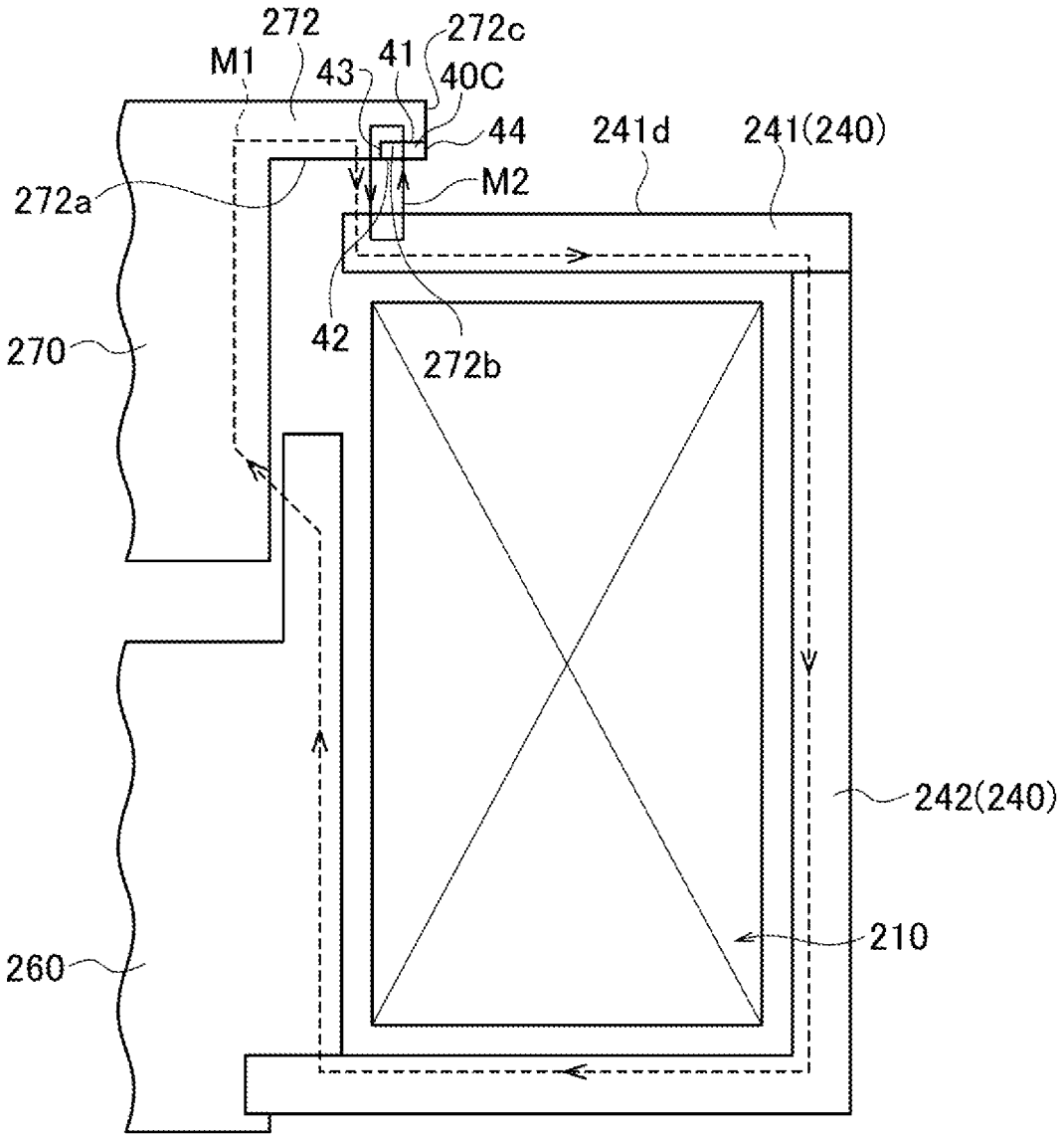
FIG. 14 is a view for schematically illustrating a flow of a magnetic flux generated in the electromagnetic relay according to the fourth embodiment of the present invention.

More particularly, as shown in FIG. 13 and FIG. 14, a permanent magnet 40C is used to generate the second magnetic flux M2, so as to improve the attractive force acting on the movable iron core (the movable member) 270 for moving toward the yoke upper plate (the fixed member) 241.

FIG. 13 simplifies the electromagnetic device 20C shown in FIG. 12. The electromagnetic device 20C according to the present embodiment is further described below with reference to FIG. 13.

The present embodiment uses the circular (ring-shaped) permanent magnet 40C having a substantially rectangular shape in cross section, as shown in FIG. 13 and FIG. 14. The permanent magnet 40C has the upper surface 41 and the lower surface 42 serving as magnetized surfaces opposed to each other in the penetration direction conforming to the vertical direction. FIG. 13 and FIG. 14 illustrate the permanent magnet 40C buried in the flange 272 of the movable iron core 270 in the state in which the upper surface 41 serves as the N-pole and the lower surface 42 serves as the S-pole.

In particular, the circular permanent magnet 40C is inserted and fixed to a groove 272*b* provided along the entire circumference on the lower side of the flange 272 of the movable iron core (the movable member) 270. In the present embodiment, the permanent magnet 40C is fixed to the movable iron core (the movable member) 270 in the state in which the upper surface 41 and the inner surface 43 are respectively brought into contact with the recessed surface and the side surface of the groove 272*b*. The permanent magnet 40C may be fixed to the movable iron core (the movable member) 270 by any conventional method such as fitting and adhesion.

This arrangement of the permanent magnet 40C leads the direction in which the paired magnetized surfaces (the upper surface 41 and the lower surface 42) of the permanent magnet 40C are opposed into conforming to the vertical direction (the reciprocating direction of the movable iron core 270).

In the present embodiment, the direction of the second magnetic flux M2 between the opposed surfaces (the opposed surface 241*d* and the opposed surface 272*a*) of the yoke upper plate (the fixed member) 241 and the movable iron core 270 conforms to the direction of the first magnetic flux M1 between the opposed surfaces (the opposed surface 241*d* and the opposed surface 272*a*) of the yoke upper plate (the fixed member) 241 and the movable iron core 270 (in FIG. 14, the downward direction).

The lower surface (the magnetized surface) 42 of the permanent magnet 40C is opposed and exposed to the opposed surface 241*d* of the yoke upper plate (the fixed member: the other member) 241.

Further, in the present embodiment, the lower surface (the magnetized surface) 42 of the permanent magnet 40C is on the same plane as the opposed surface 272*a* of the flange 272 (the movable member: the member to which the permanent magnet 40C is attached). The outer surface 44 of the permanent magnet 40C is on the same plane as the outer surface 272*c* of the flange 272.

The present embodiment described above can also achieve the similar advantageous effects as the first embodiment.

Figure 15:
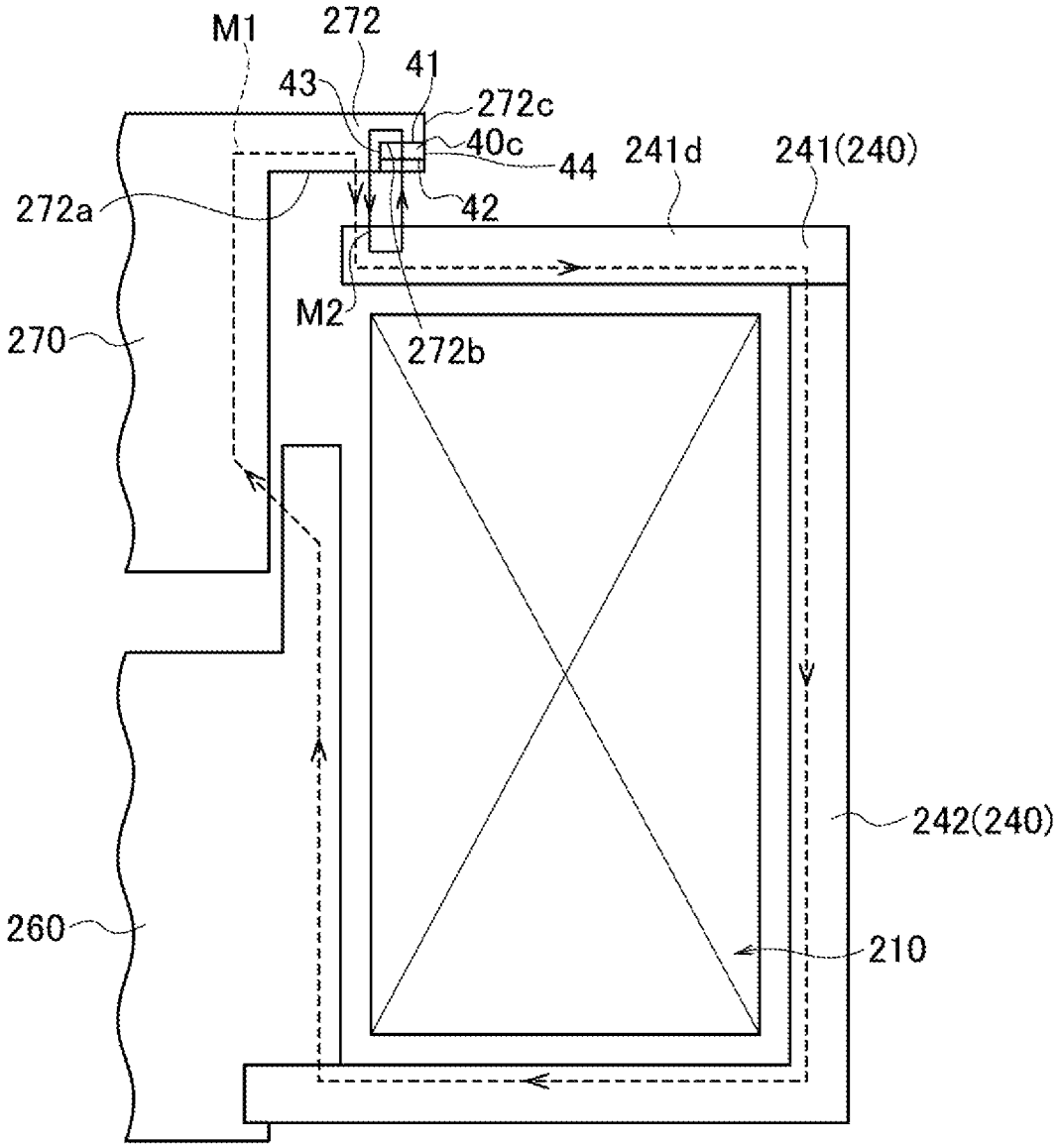
FIG. 15 is a view for schematically illustrating a flow of a magnetic flux generated in an electromagnetic relay according to a first modified example of the fourth embodiment of the present invention.

Alternatively, as shown in FIG. 15, the permanent magnet 40C may be arranged such that the lower surface (the magnetized surface) 42 is located above the opposed surface 272*a* of the flange 272 (the movable member: the member to which the permanent magnet 40C is attached). In other words, a gap may be provided between the lower surface 42 and the opposed surface 241*d* of the yoke upper plate (the fixed member) 241 when the opposed surface 241*d* is in contact with the opposed surface 272*a* of the flange 272.

This arrangement can also increase the magnetic flux (the second magnetic flux M2) generated by the permanent magnet 40C and flowing through the opposed surfaces more efficiently, so as to further improve the attractive force acting on the movable iron core (the movable member) 270 for moving toward the yoke upper plate (the fixed member) 241.

This arrangement can also prevent damage to the permanent magnet 40C since the lower surface 42 is not brought into contact with the opposed surface 241*d* when the current is applied to the coil 230.

Figure 16:
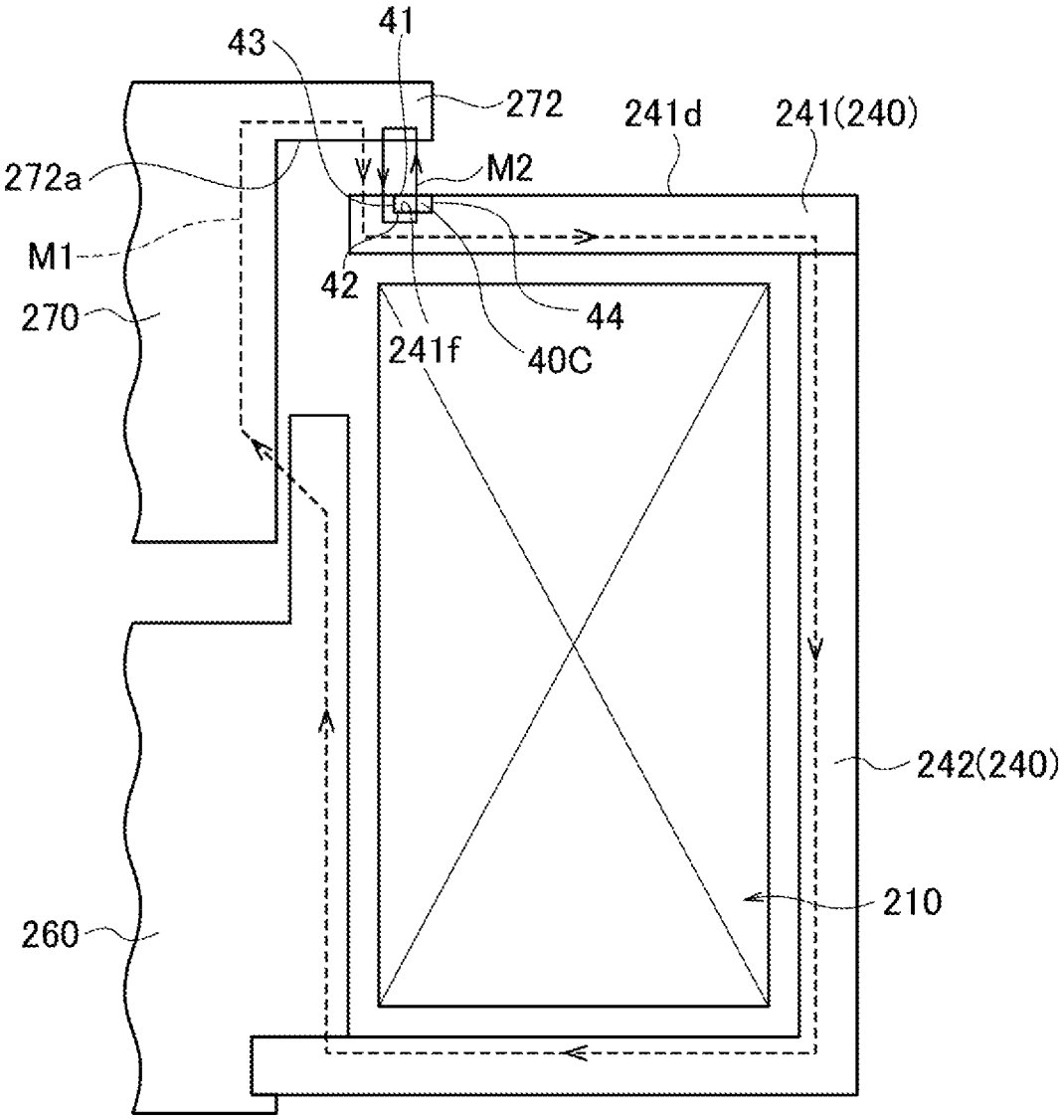
FIG. 16 is a view for schematically illustrating a flow of a magnetic flux generated in an electromagnetic relay according to a second modified example of the fourth embodiment of the present invention.

The circular permanent magnet 40C may be arranged in the upper yoke plate (the fixed member: at least one of the fixed member and the movable member) 241, as shown in FIG. 16.

FIG. 16 illustrates the circular permanent magnet 40C inserted and fixed to a groove 241*f* provided along the entire circumference of the insertion hole 242*a* on the upper side of the yoke upper plate (the fixed member) 241.

This arrangement of the permanent magnet 40C leads the direction in which the paired magnetized surfaces (the upper surface 41 and the lower surface 42) of the permanent magnet 40C are opposed into conforming to the vertical direction (the reciprocating direction of the movable iron core 270).

In the present embodiment, the direction of the second magnetic flux M2 between the opposed surfaces (the opposed surface 241*d* and the opposed surface 272*a*) of the yoke upper plate (the fixed member) 241 and the flange 272 conforms to the direction of the first magnetic flux M1 between the opposed surfaces (the opposed surface 241*d* and the opposed surface 272*a*) of the yoke upper plate (the fixed member) 241 and the flange 272 (in FIG. 16, the downward direction).

The upper surface (the magnetized surface) 41 of the permanent magnet 40C is opposed and exposed to the opposed surface 272*a* of the flange 272 (the movable member: the other member).

Further, in the present embodiment, the upper surface (the magnetized surface) 41 of the permanent magnet 40C is on the same plane as the opposed surface 241*d* of the yoke upper plate (the fixed member: the member to which the permanent magnet 40C is attached) 241.

This arrangement can also increase the magnetic flux (the second magnetic flux M2) generated by the permanent magnet 40C and flowing through the opposed surfaces more efficiently, so as to further improve the attractive force acting on the movable iron core (the movable member) 270 for moving toward the yoke upper plate (the fixed member) 241.

Figure 17:
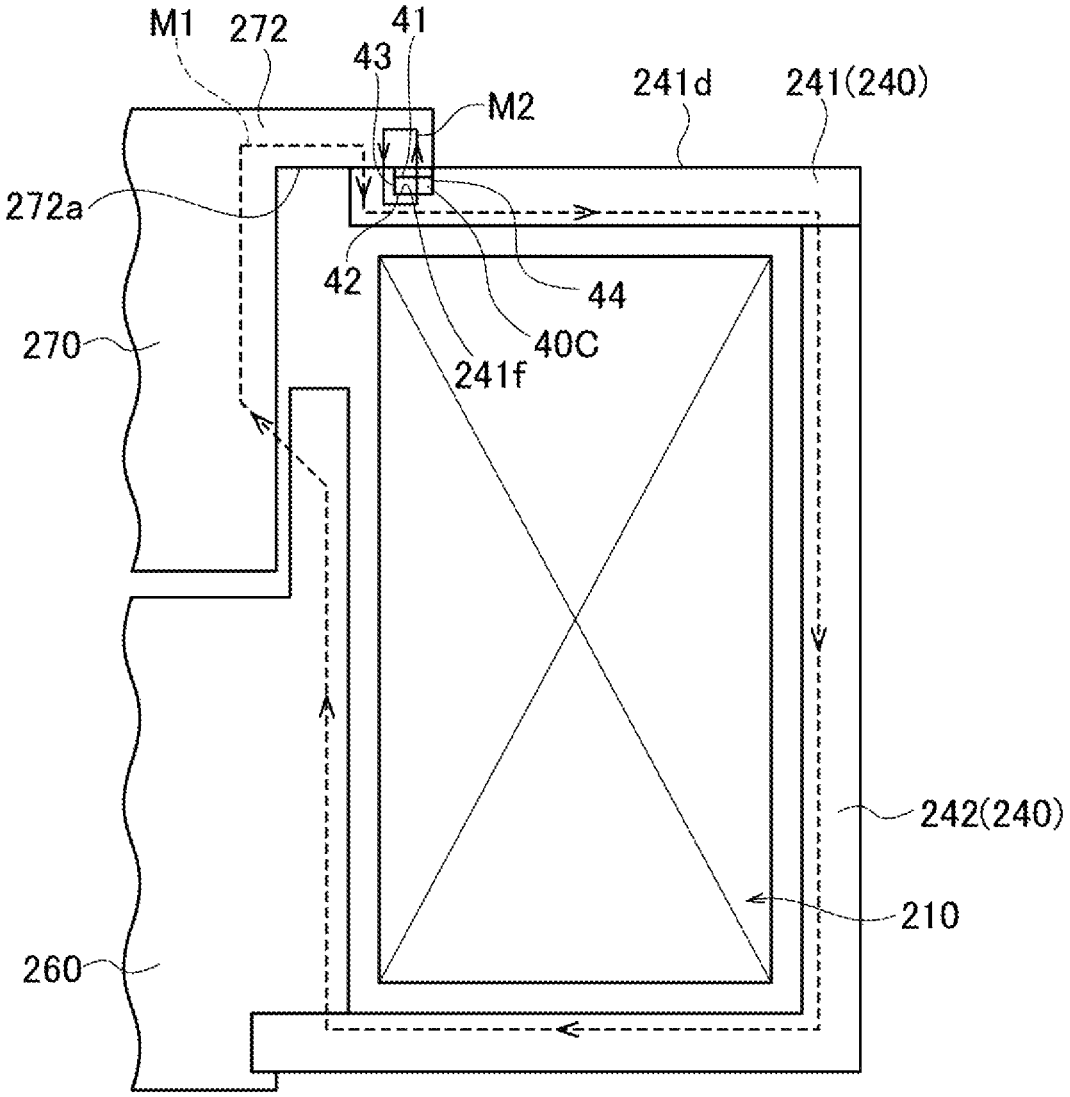
FIG. 17 is a view for schematically illustrating a flow of a magnetic flux generated in an electromagnetic relay according to a third modified example of the fourth embodiment of the present invention.

Alternatively, as shown in FIG. 17, the permanent magnet 40C may be arranged such that the upper surface (the magnetized surface) 41 is located below the opposed surface 241*d* of the yoke upper plate (the fixed member: the member to which the permanent magnet 40C is attached) 241. In other words, a gap may be provided between the upper surface 41 and the opposed surface 272*a* of the flange 272 when the opposed surface 241*d* of the yoke upper plate (the fixed member) 241 is in contact with the opposed surface 272*a*.

This arrangement can prevent damage to the permanent magnet 40C.

While the present invention has been described above by reference to the preferred embodiments, the present invention is not intended to be limited to the descriptions thereof, and various modifications will be apparent to those skilled in the art.

For example, although the embodiments exemplified the case in which the yoke 370 includes the upper yoke 371 and the lower yoke 372, the yoke 370 may include one of the upper yoke 371 and the lower yoke 372, or the electromagnetic relay may exclude the yoke 370.

Although the embodiments exemplified the case in which the pressure spring 340 is inserted into the insertion hole 372*a* of the lower yoke 372, the pressure spring 340 may be in contact with the lower yoke 372.

The coil bobbin 220 may have various kinds of shapes, and the position of the coil bobbin 220 may be varied as appropriate.

Although the embodiments exemplified the case in which the permanent magnet 40 is attached to the fixed iron core 260, the permanent magnet 40 may be attached to the movable iron core 270 or may be attached to both the fixed iron core 260 and the movable iron core 270.

Although the embodiments illustrated the integrated circular (ring-shaped) permanent magnet, a permanent magnet divided into several parts may be used and assembled into a circular shape (a ring-like shape) when attached to the iron core.

For example, a plurality of permanent magnets each formed into an arc of a ring (arc-like permanent magnets each having a central angle of less than 360°: doughnut-shaped divided permanent magnets) may be used and assembled into a circular shape (a ring-like shape) when attached to the iron core.

Namely, pieces of permanent magnets in which the sum of the central angles is 360° are assembled without gap in the circumferential direction, so as to be formed into a circular shape (a ring-like shape) when attached to the iron core.

For example, two pieces of permanent magnets each having a central angle of 180° may be used, or two pieces of permanent magnets in which one has a central angle of 300° and the other has a central angle of 60° may be used.

A permanent magnet formed into an arc of a circle may only be attached to the iron core.

A plurality of permanent magnets may be assembled with at least a single gap provided in the circumferential direction and attached to the iron core. For example, a plurality of permanent magnets may be arranged radially, or may be arranged into a C-shape and attached to the iron core.

Alternatively, at least one substantially bar-shaped permanent magnet (a bar magnet: a permanent magnet having a substantially rectangular cuboid) may be used and attached to the iron core.

Although the embodiments exemplified the case in which the permanent magnet is attached to the outer circumferential surface of the iron core, the permanent magnet may be attached to the inner circumferential surface of the iron core.

The permanent magnet may be attached to both the inner circumferential surface and the outer circumferential surface of the iron core, or may be attached to the iron core such that the opposed surface of the iron core opposed to the other iron core entirely serves as a magnetized surface.

The movable contact, the fixed terminals, and the other specifications (such as the shape, the size, and the layout) may also be varied as appropriate.

What is claimed is:

1. An electromagnetic device comprising:

a coil configured to generate a first magnetic flux when a current is applied thereto;

a yoke, arranged around the coil, through which the first magnetic flux flows;

a movable iron core configured to reciprocate to separate from the yoke by a predetermined gap when the current applied to the coil is stopped and move to the yoke by an attractive force when the current is applied to the coil; and a permanent magnet configured to generate a second magnetic flux between opposed surfaces of the yoke and the movable iron core in a direction conforming to the first magnetic flux, the opposed surface of the yoke and the opposed surface of the movable iron core are opposed in first direction parallel to a reciprocating direction of the movable iron core, wherein the permanent magnet is attached to the movable iron core such that a magnetized surface of the permanent magnet is opposed and exposed to the opposed surface of the yoke.

2. The electromagnetic device according to claim 1, wherein the permanent magnet is formed into a ring-like shape.

3. The electromagnetic device according to claim 1, wherein the magnetized surface of the permanent magnet is on a plane identical to the opposed surface of the movable iron core.

4. The electromagnetic device according to claim 1, wherein the magnetized surface of the permanent magnet is on a different plane from the opposed surface of the movable iron core.

5. The electromagnetic device according to claim 1, wherein the yoke extends along the second direction perpendicular to the first direction.

6. An electromagnetic relay equipped with the electromagnetic device according to claim 1.

* * * * *